US011158229B2

(12) United States Patent
Lim

(10) Patent No.: US 11,158,229 B2
(45) Date of Patent: Oct. 26, 2021

(54) WIRELESS RECEPTION DEVICE AND IMAGE DISPLAY APPARATUS INCLUDING THE SAME

(71) Applicant: LG ELECTRONICS INC., Seoul (KR)

(72) Inventor: Sangchae Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/165,462

(22) Filed: Feb. 2, 2021

(65) Prior Publication Data

US 2021/0241668 A1 Aug. 5, 2021

(30) Foreign Application Priority Data

Feb. 3, 2020 (KR) ..... 10-2020-0012720

(51) Int. Cl.
*G09G 3/20* (2006.01)

(52) U.S. Cl.
CPC ..... *G09G 3/20* (2013.01); *G09G 2310/08* (2013.01); *G09G 2360/12* (2013.01); *G09G 2370/10* (2013.01); *G09G 2370/16* (2013.01)

(58) Field of Classification Search
CPC .. G09G 3/20; G09G 2310/08; G09G 2360/12; G09G 2370/10; G09G 2370/16
See application file for complete search history.

(56) References Cited

U.S. PATENT DOCUMENTS

2018/0082475 A1* 3/2018 Sharma ..... G06F 3/147
2018/0082633 A1* 3/2018 Tan ..... G09G 3/20
2018/0088339 A1* 3/2018 Aruga ..... G02B 27/0172
2018/0089935 A1* 3/2018 Froy, Jr. ..... G07F 17/3213
2018/0090074 A1* 3/2018 Jin ..... G09G 3/3233

* cited by examiner

*Primary Examiner* — Sejoon Ahn

(74) *Attorney, Agent, or Firm* — Lee, Hong, Degerman, Kang & Waimey PC

(57) ABSTRACT

The present disclosure relates to a wireless reception device and an image display apparatus including the same. The image display apparatus includes a first signal converter configured to convert an input signal based on the RF signal into a first baseband signal, a second signal converter configured to convert the input signal based on the RF signal into a second baseband signal, a processor of a first standard configured to perform signal processing on the first baseband signal from the first signal converter based on a first standard, and a first processor of a second standard configured to perform signal processing on the second baseband signal from the second signal converter based on the second standard. Accordingly, the time delay when signal processing is performed on input signals of a plurality of standards is reduced.

20 Claims, 26 Drawing Sheets

T=Tx1

T=Tm3

FIG. 15C

| Syntax | No. of Bits | Format |
|---|---|---|
| L1_Basic_signaling() { | | |
| L1B_version | 3 | uimsbf |
| L1B_mimo_scattered_pilot_encoding | 1 | uimsbf |
| L1B_lls_flag | 1 | uimsbf |
| L1B_time_info_flag | 2 | uimsbf |
| L1B_return_channel_flag | 1 | uimsbf |
| L1B_papr_reduction | 2 | uimsbf |
| L1B_frame_length_mode | 1 | uimsbf |
| if ( L1B_frame_length_mode=0 ) { | | |
| L1B_frame_length | 10 | uimsbf |
| L1B_excess_samples_per_symbol | 13 | uimsbf |
| } else { | | |
| L1B_time_offset | 16 | uimsbf |
| L1B_additional_samples | 7 | uimsbf |
| } | | |
| L1B_num_subframes | 8 | uimsbf |
| L1B_preamble_num_symbols | 3 | uimsbf |
| L1B_preamble_reduced_carriers | 3 | uimsbf |
| L1B_L1_Detail_content_tag | 2 | uimsbf |
| L1B_L1_Detail_size_bytes | 13 | uimsbf |
| L1B_L1_Detail_fec_type | 3 | uimsbf |
| L1B_L1_Detail_additional_parity_mode | 2 | uimsbf |
| L1B_L1_Detail_total_cells | 19 | uimsbf |
| L1B_first_sub_mimo | 1 | uimsbf |
| L1B_first_sub_miso | 2 | uimsbf |
| L1B_first_sub_fft_size | 2 | uimsbf |
| L1B_first_sub_reduced_carriers | 3 | uimsbf |
| L1B_first_sub_guard_interval | 4 | uimsbf |
| L1B_first_sub_num_ofdm_symbols | 11 | uimsbf |
| L1B_first_sub_scattered_pilot_pattern | 5 | uimsbf |
| L1B_first_sub_scattered_pilot_boost | 3 | uimsbf |
| L1B_first_sub_sbs_first | 1 | uimsbf |
| L1B_first_sub_sbs_last | 1 | uimsbf |
| L1B_reserved | 48 | uimsbf |
| L1B_crc | 32 | uimsbf |
| } | | |

| Cred_coeff | Number of Carriers (NoC) | | |
|---|---|---|---|
| | 8K FFT | 16K FFT | 32K FFT |
| 0 | 6913 | 13825 | 27649 |
| 1 | 6817 | 13633 | 27265 |
| 2 | 6721 | 13441 | 26881 |
| 3 | 6625 | 13249 | 26497 |
| 4 | 6529 | 13057 | 26113 |

WIRELESS RECEPTION DEVICE AND IMAGE DISPLAY APPARATUS INCLUDING THE SAME

CROSS-REFERENCE TO THE RELATED APPLICATION

Pursuant to 35 U.S.C. § 119(a), this application claims the benefit of earlier filing date and right of priority to Korean Patent Application No. 10-2020-0012720, filed on Feb. 3, 2020, the contents of which are hereby incorporated by reference herein in its entirety.

BACKGROUND OF THE PRESENT DISCLOSURE

1. Field of the Present Disclosure

The present disclosure relates to a wireless reception device and an image display apparatus including the same, and more particularly to a wireless reception device and an image display apparatus including the same for reducing the time delay when signal processing is performed on input signals of a plurality of standards.

2. Description of the Related Art

A wireless reception device is an apparatus for receiving and processing a terrestrial digital broadcasting signal and a mobile communication signal.

The wireless reception device receives a radio frequency (RF) signal, which includes noise from a communication channel, via an antenna, and performs signal processing on the received RF signal.

When signals of a plurality of standards are included in an RF signal received by a wireless reception device, a method of processing a signal of each standard without time delay is required.

SUMMARY OF THE PRESENT DISCLOSURE

It is an object of the present disclosure to provide a wireless reception device and an image display apparatus including the same for reducing the time delay when signal processing is performed on input signals of a plurality of standards.

In accordance with an aspect of the present disclosure, the above objects can be accomplished by providing a wireless reception device and an image display apparatus including the same, including a first signal converter configured to convert an input signal based on the RF signal into a first baseband signal, a second signal converter configured to convert the input signal based on the RF signal into a second baseband signal, a processor of a first standard configured to perform signal processing on the first baseband signal from the first signal converter based on the first standard, and a first processor of a second standard configured to perform signal processing on the second baseband signal from the second signal converter based on the second standard, wherein, when standard of the input signal based on the RF signal is not detected, the processor of the first standard performs signal processing on the first baseband signal from the first signal converter based on the first standard during a first period, and the first processor of the second standard performs signal processing on the second baseband signal from the second signal converter based on the second standard during the first period, when the standard of the input signal is detected by the signal processing during the first period, the first signal converter 122 outputs a baseband signal of the first standard or a baseband signal of the second standard based on the detected standard during a second period after the first period.

When the input signal based on the RF signal is detected as a first input signal of the first standard, the first signal converter converts the first input signal of the first standard into the first baseband signal, the processor of a first standard processes the first baseband signal from the first signal converter based on the first standard, and the first processor of a second standard does not operate, when the input signal based on the RF signal is detected as a second input signal of the second standard, the second signal converter converts the second input signal of the second standard into the second baseband signal using sample rate information processed by the first processor of the second standard during the first period.

A sample rate of the first baseband signal output from the first signal converter and a sample rate of the second baseband signal output from the second signal converter may be different from each other.

The wireless reception device and the image display apparatus including the same may further include a second processor of the second standard configured to perform second signal processing of the second standard based on a signal output from the first processor of the second standard.

The first processor of the second standard may decode bootstrap data, and the second processor of the second standard may decode preamble data and subframe data.

The first standard may be an ATSC 1.0 standard, and the second standard may be an ATSC 3.0 standard.

When the input signal based on the RF signal is the first input signal of the first standard, the first signal converter may convert the first input signal of the first standard into the first baseband signal, and the second signal converter and the first processor of the second standard may not be operated.

When the input signal based on the RF signal is the second input signal of the second standard, the second signal converter may convert the second input signal of the second standard into the second baseband signal, the first processor of the second standard may perform signal processing based on the second baseband signal and outputs sample rate information, obtained via the signal processing, to the first signal converter, and the first signal converter may convert the second input signal of the second standard into a third baseband signal based on the sample rate information from the first processor of the second standard.

The wireless reception device and the image display apparatus including the same may further include a second processor of the second standard configured to perform signal processing based on the third baseband signal from the first signal converter.

When the first signal converter receives the sample rate information, a sample rate of the third baseband signal may be different from a sample rate of the first baseband signal and a sample rate of the second baseband signal.

When the first signal converter receives the sample rate information, the third baseband signal may have a plurality of sample rates.

The preamble data may include basic signaling data and detailed signaling data.

The wireless reception device and the image display apparatus including the same may further include a synchronizer including a first processor of the second standard, and an error corrector including a second processor of the second standard.

Payload data of the first frame data may begin to be processed within a first frame data period or a reception period of first frame data.

The wireless reception device and the image display apparatus including the same may further include an equalizer configured to regenerate a preamble of the first frame data and the first subframe based on basic signaling data of the first frame data decoded by the first processor of the second standard.

A time at which basic signaling data of the first frame data is completely decoded may be after a time at which first subframe data of the first frame data input to the synchronizer is completely input and may be before a time at which second subframe data of the first frame data is completely input.

The wireless reception device and the image display apparatus including the same may further include a tuner module configured to receive the RF signal.

In accordance with another aspect of the present disclosure, the above objects can be accomplished by providing a wireless reception device and an image display apparatus including the same, including a first signal converter configured to convert an input signal based on the RF signal into a first baseband signal, a second signal converter configured to convert the input signal based on the RF signal into a second baseband signal, a processor of a first standard configured to perform signal processing on the first baseband signal from the first signal converter based on the first standard, and a first processor of a second standard configured to perform signal processing on the second baseband signal from the second signal converter based on the second standard, wherein, when standard of the input signal based on the RF signal is not detected, the processor of the first standard and the first processor 920 of the second standard do not sequentially operate with each other, and the processor of the first standard and the first processor of the second standard simultaneously perform respective signal processing operations.

In accordance with another aspect of the present disclosure, the above objects can be accomplished by providing an image display apparatus comprising a wireless reception device for receiving a radio frequency (RF) signal received through a channel, a signal processing device configured to process an signal from the wireless reception device, and a display configured to display an image based on a video signal from the signal processing device.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE PREFERRED EMBODIMENTS

Hereinafter, embodiments of the present disclosure will be described in further detail with reference to the accompanying drawings.

In the following description, the terms "module" and "unit", which are used herein to signify components, are merely intended to facilitate explanation of the present disclosure, and the terms do not have any distinguishable difference in meaning or role. Thus, the terms "module" and "unit" may be used interchangeably.

Figure 1:
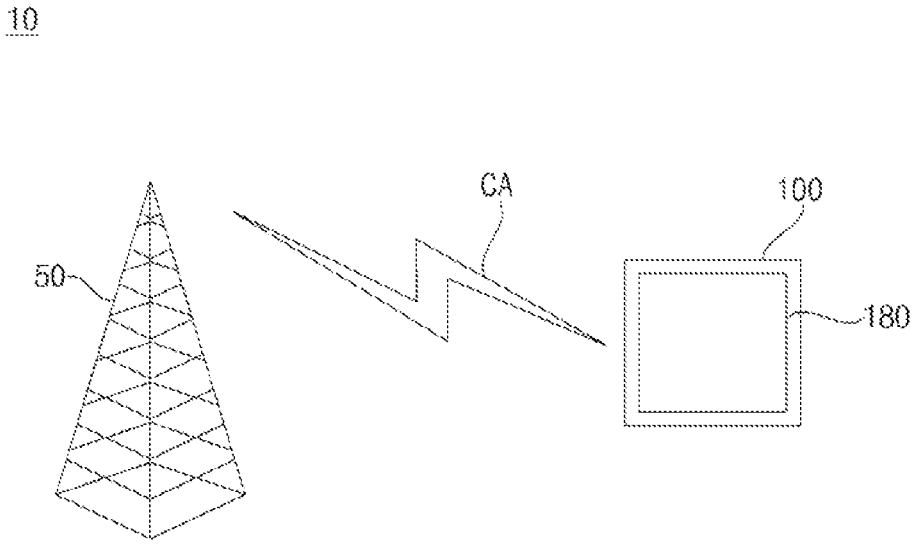
FIG. 1 is a diagram illustrating a radio frequency (RF) signal receiving system according to an embodiment of the present disclosure.

FIG. 1 is a diagram illustrating a radio frequency (RF) signal receiving system according to an embodiment of the present disclosure.

Referring to FIG. 1, an RF signal receiving system 10 according to an embodiment of the present disclosure may include a wireless signal transmitting device 50 for transmitting an RF signal CA, and a wireless reception device 80 for receiving the RF signal CA.

The wireless reception device 80 according to an embodiment of the present disclosure may be a wireless reception device for receiving an RF signal including input signals according a plurality of standards.

To this end, a wireless reception device 800*m* (refer to FIG. 9) according to an embodiment of the present disclosure may include a first signal converter 122 for converting an input signal based on an RF signal into a first baseband signal, a second signal converter 124 for converting the input signal based on the RF signal into a second baseband signal, a processor 910 of a first standard for performing signal processing on the first baseband signal from the first signal converter 122 based on a first standard, and a first processor 920 of a second standard for performing signal processing on the second baseband signal from the second signal converter 124 based on the second standard, and in this case, when standard of the input signal based on the RF signal is not detected, the processor 910 of the first standard may perform signal processing based on the first baseband signal from the first signal converter 122 based on the first standard during a first period, and the first processor 920 of the second standard may perform signal processing on the second baseband signal from the second signal converter 124 based on the second standard during the first period, when the standard of the input signal is detected by the signal processing during the first period, the first signal converter 122 outputs a baseband signal of the first standard or a baseband signal of the second standard based on the detected standard during a second period after the first period.

Accordingly, the time delay when signal processing is performed on input signals of a plurality of standards may be reduced. In particular, it is possible to reduce the time delay during signal processing when the standard of the input signal is not detected.

The wireless reception device 800*m* (refer to FIG. 9) according to another embodiment of the present disclosure may include the first signal converter 122 for converting an input signal based on an RF signal into the first baseband signal, the second signal converter 124 for converting the input signal based on the RF signal into the second baseband signal, the processor 910 of the first standard for performing signal processing on the first baseband signal from the first signal converter 122 based on the first standard, and the first processor 920 of the second standard for performing signal processing on the second baseband signal from the second signal converter 124 based on the second standard, and in this case, when standard of the input signal based on the RF signal is not detected, the processor 910 of the first standard and the first processor 920 of the second standard do not sequentially operate with each other, and the processor 910 of the first standard and the first processor 920 of the second standard may simultaneously perform respective signal processing operations. Accordingly, the time delay when signal processing is performed on input signals of a plurality of standards may be reduced. In particular, it is possible to reduce the time delay during signal processing when the standard of the input signal is not detected.

The RF signal CA of FIG. 1 may be a digital broadcasting signal, in which case the wireless reception device 80 of FIG. 1 may be included in an image display device 100 (refer to FIG. 2A) such as a TV or a mobile terminal 100*b* (refer to FIG. 2B) such as a cellular phone or a tablet terminal.

The RF signal CA may be a broadcasting signal based on the ATSC 1.0 standard or the ATSC 3.0 standard.

Figure 2A:
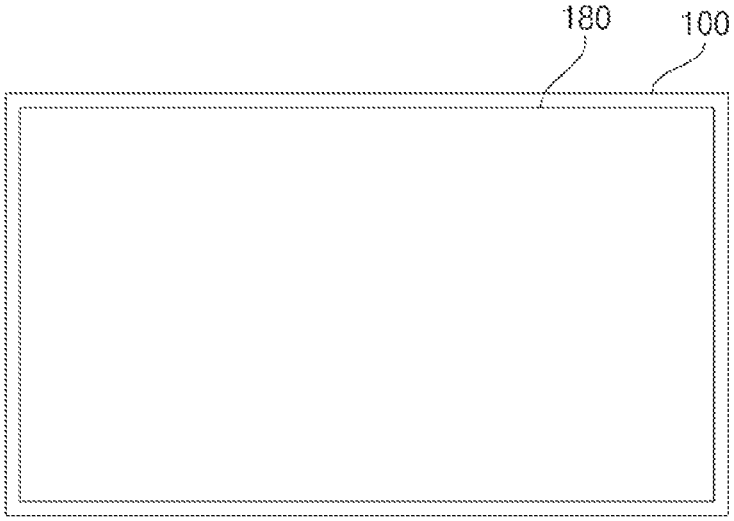
FIG. 2A is a diagram showing an example of an image display apparatus according to an embodiment of the present disclosure.

FIG. 2A is a diagram showing an example of an image display apparatus according to an embodiment of the present disclosure.

Referring to FIG. 2A, the image display apparatus 100 of FIG. 2A may include a display 180 and may also include the wireless reception device 80 described with reference to FIG. 1.

The image display apparatus 100 of FIG. 2A may include the first signal converter 122 for converting the input signal based on the RF signal into the first baseband signal, the second signal converter 124 for converting the input signal based on the RF signal into the second baseband signal, the processor 910 of the first standard for performing signal processing on the first baseband signal from the first signal converter 122 based on the first standard, and the first processor 920 of the second standard for performing signal processing on the second baseband signal from the second signal converter 124 based on the second standard, and in this case, when standard of the input signal based on the RF signal is not detected, the processor 910 of the first standard may perform signal processing on the first baseband signal from the first signal converter 122 based on the first standard during a first period, and the first processor 920 of the second standard may include the wireless reception device 800*m* for performing signal processing on the second baseband signal from the second signal converter 124 based on the second standard, when the standard of the input signal is detected by the signal processing during the first period, the first signal converter 122 outputs a baseband signal of the first standard or a baseband signal of the second standard based on the detected standard during a second period after the first period.

Accordingly, the time delay when signal processing is performed on input signals of a plurality of standards may be reduced.

Figure 2B:
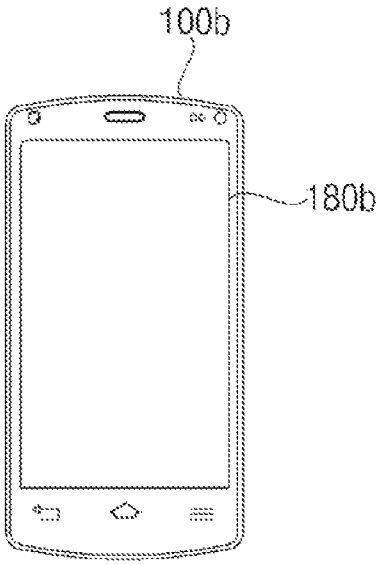
FIG. 2B is a diagram showing another example of an image display apparatus according to an embodiment of the present disclosure.

FIG. 2B is a diagram showing another example of an image display apparatus according to an embodiment of the present disclosure.

Referring to FIG. 2B, the mobile terminal 100*b* of FIG. 2B may include a display 180*b*, and may also include the wireless reception device 80 described in FIG. 1.

The mobile terminal 100*b* of FIG. 2B may include the first signal converter 122 for converting the input signal based on the RF signal into the first baseband signal, the second signal converter 124 for converting the input signal based on the RF signal into the second baseband signal, the processor 910 of the first standard for performing signal processing on the first baseband signal from the first signal converter 122 based on the first standard, and the first processor 920 of the second standard for performing signal processing on the second baseband signal from the second signal converter 124 based on the second standard, and in this case, when the input signal based on the RF signal is detected as a first input signal of the first standard, the processor 910 of the first standard may perform signal processing on the first baseband signal from the first signal converter 122 based on the first standard during a first period, and the first processor 920 of the second standard may perform signal processing on the second baseband signal from the second signal converter 124 based on the second standard during the first period, when the standard of the input signal is detected by the signal processing during the first period, the first signal converter 122 outputs a baseband signal of the first standard or a baseband signal of the second standard based on the detected standard during a second period after the first period.

Accordingly, the time delay when signal processing is performed on input signals of a plurality of standards may be reduced.

Figure 3:
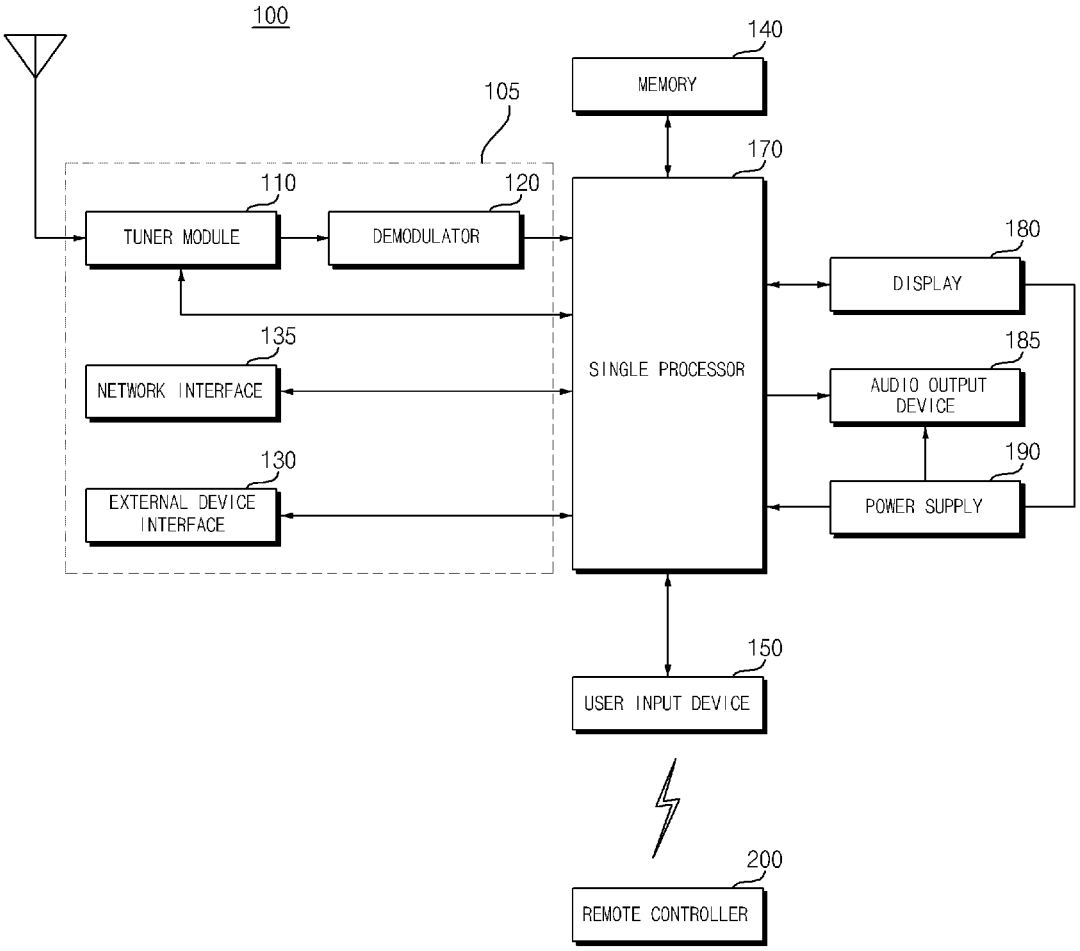
FIG. 3 is an internal block diagram of the image display apparatus of FIG. 2A.

FIG. 3 is an internal block diagram of the image display apparatus of FIG. 2A.

Referring to FIG. 3, the image display apparatus 100 according to an embodiment of the present disclosure includes a broadcast receiver 105, an external device interface 130, a memory 140, a user input interface 150, a sensor unit (not shown), a signal processor 170, a display 180, and an audio output device 185.

The broadcast receiver 105 includes a tuner module 110, a demodulator 120, a network interface 135, and an external device interface 130.

Unlike the embodiment of FIG. 3, the demodulator 120 may be included in the tuner module 110.

Further, unlike the embodiment of FIG. 3, the broadcast receiver 105 may include only the tuner module 110, the demodulator 120, and the external interface 135, i.e., without including the network interface 135.

The tuner module 110 may tune a Radio frequency (RF) broadcast signal corresponding to a channel selected by a user or all the previously stored channels, among RF broadcast signals received via an antenna (not shown). In addition, the tuner module 110 may convert the tuned RF broadcast signal into an intermediate frequency signal or a baseband signal (baseband image signal or baseband audio signal).

For example, if the selected RF broadcast signal is a digital broadcast signal, the tuner module 110 converts the digital broadcast signal into a digital IF signal (DIF), and if the selected RF broadcast signal is an analog broadcast signal, the tuner module 110 converts the analog broadcast signal into a baseband image or an audio signal (CVBS/SIF). That is, the tuner module 110 may process the digital broadcast signal or the analog broadcast signal. The analog baseband image or the audio signal (CVBS/SIF), which is output from the tuner module 110, may be directly input to the signal processor 170.

The tuner module 110 may include a plurality of tuner modules to receive broadcast signals of a plurality of channels. Alternatively, the tuner module 110 may be a single turner which receives broadcast signals of a plurality of channels simultaneously.

The demodulator 120 may receive the digital IF (DIF) signal converted by the tuner module 110, and may demodulate the digital IF signal.

For example, the demodulator 120 may convert the digital IF (DIF) signal, which is converted by the tuner module 110, into a baseband signal.

Upon performing demodulation and channel decoding, the demodulator 120 may output a stream signal (TS). Here, the stream signal may be a signal obtained by multiplexing an image signal, an audio signal, or a data signal.

The stream signal, output from the demodulator 120, may be input into the signal processor 170. Upon performing demultiplexing, A/V signal processing, and the like, the signal processor 170 may output video to the display 180 and audio to the audio output device 185.

The external device interface 130 may be connected to an external device (not shown), e.g., a set-top box 50, to transmit or receive data. To this end, the external device interface 130 may include an A/V input and output device (not shown).

The external device interface 130 may be connected, wirelessly or by wire, to an external device, such as a digital versatile disk (DVD), a Blu-ray, a game console, a camera, a camcorder, a computer (laptop computer), a set-top box, and the like, and may perform an input/output operation with the external device.

The A/V input/output device may receive input of image and audio signals of the external device. A wireless communicator (not shown) may perform short range wireless communication with other electronic devices.

By connection with such wireless communicator (not shown), the external device interface 130 may exchange data with an adjacent mobile terminal 160. Particularly, in a mirroring mode, the external device interface 130 may receive device information, information on executed applications, application images, and the like from the mobile terminal 600.

The network interface 135 serves as an interface for connecting the image display apparatus 100 and a wired or wireless network such as the Internet. For example, the network interface 135 may receive contents or data from the Internet, a content provider, or a network operator over a network.

Further, the network interface 135 may include the wireless communicator (not shown).

The memory 140 may store programs for processing and controlling each signal by the signal processor 170, or may store processed video, audio, or data signals.

In addition, the memory 140 may also temporarily store video, audio, or data signals input via the external device interface 130. Furthermore, the memory 140 may store information related to a predetermined broadcast channel using a channel memory function of a channel map and the like.

While FIG. 3 illustrates an example where the memory 140 is separately provided from the signal processor 170, the present disclosure is not limited thereto, and the memory 140 may be included in the signal processor 170.

The user input interface 150 transmits a signal, input by a user, to the signal processor 170, or transmits a signal from the signal processor 170 to the user.

For example, the user input interface 150 may transmit/receive user input signals, such as a power on/off signal, a channel selection signal, a screen setting signal, and the like, to and from a remote signal processor 200; may transfer a user input signal, which is input from a local key (not shown), such as a power key, a channel key, a volume key, or a setting key, to the signal processor 170; may transfer a user input signal, which is input from a sensor unit (not shown) for sensing a user's gesture, to the signal processor 170; or may transmit a signal from the signal processor 170 to the sensor unit (not shown).

The signal processor 170 may demultiplex stream, which is input via the tuner module 110, the demodulator 120, a network interface 135, or the external interface unit 130, or may process the demultiplexed signals, to generate and output signals for outputting video or audio.

The video signal processed by the signal processor 170 may be input to the display 180 to be output as a video corresponding to the video signal. Further, the video signal processed by the signal processor 170 may be input to an external output device via the external device interface 130.

The audio signal processed by the signal processor 170 may be output to the audio output device 185. Further, the audio signal processed by the signal processor 170 may be input to the external output device through the external device interface 130.

Although not illustrated in FIG. 3, the signal processor 170 may include a demultiplexer, a video processor, and the like, which will be described later with reference to FIG. 4.

In addition, the signal processor 170 may control the overall operation of the image display apparatus 100. For example, the signal processor 170 may control the tuner module 110 to tune to an RF broadcast corresponding to a user selected channel or a pre-stored channel.

Further, the signal processor 170 may control the image display apparatus 100 by a user command input via the user input interface 150 or an internal program.

For example, the signal processor 170 may control the display 180 to display an image. In this case, the image displayed on the display 180 may be a still image or a video, or a 2D or 3D image.

In addition, the signal processor 170 may control the display 180 to display a predetermined object in the displayed image. For example, the object may be at least one of an accessed web screen (newspaper, magazine, etc.), an Electronic Program Guide (EPG), various menus, a widget, an icon, a still image, a video, and text.

The signal processor 170 may recognize a user's location based on an image captured by a capturing unit (not shown). For example, the signal processor 170 may recognize a distance (z-axial coordinates) between the user and the image display apparatus 100. Also, the signal processor 170 may recognize x-axial coordinates and y-axial coordinates in the display 180 corresponding to the user's location.

The display 180 converts a video signal, a data signal, an OSD signal, a control signal which are processed by the signal processor 170, or a video signal, a data signal, a control signal, and the like which are received via the external device interface 130, to generate a driving signal.

Further, the display 180 may be implemented as a touch screen to be used as an input device as well as an output device.

The audio output device 185 may output sound by receiving an audio signal processed by the signal processor 170.

The capturing unit (not shown) captures a user's image. The capturing unit (not shown) may be implemented with a single camera, but is not limited thereto, and may be implemented with a plurality of cameras. The image information captured by the capturing unit (not shown) may be input to the signal processor 170.

The signal processor 170 may sense a user's gesture based on the image captured by the capturing unit (not shown), a signal sensed by the sensor unit (not shown), or a combination thereof.

The power supply 190 may supply power throughout the image display apparatus 100. Particularly, the power supply 190 may supply power to the signal processor 170 which may be implemented in a form of a system on chip (SOC), the display 180 to display an image, and the audio output device 185 to output an audio.

Specifically, the power supply 190 may include a converter which converts an alternating current into a direct current, and a dc/dc converter which converts the level of the direct current.

The remote signal processor 200 transmits a user input to the user input interface 150. To this end, the remote signal processor 200 may use various communication techniques, such as Bluetooth, RF communication, IR communication, Ultra Wideband (UWB), ZigBee, and the like. Further, the remote signal processor 200 may receive video, audio, or data signals output from the user input interface 150, to display the signals on the remote signal processor 200 or output the signal thereon in the form of sound.

The above described image display apparatus 100 may be a fixed or mobile digital broadcast receiver capable of receiving digital broadcast.

The block diagram of the image display apparatus 100 illustrated in FIG. 3 is only by example. Depending upon the specifications of the image display apparatus 100 in actual implementation, the components of the image display apparatus 100 may be combined or omitted or new components may be added. That is, two or more components may be incorporated into one component or one component may be configured as separate components, as needed. In addition, the function of each block is described for the purpose of describing the embodiment of the present disclosure and thus specific operations or devices should not be construed as limiting the scope and spirit of the present disclosure.

Figure 4:
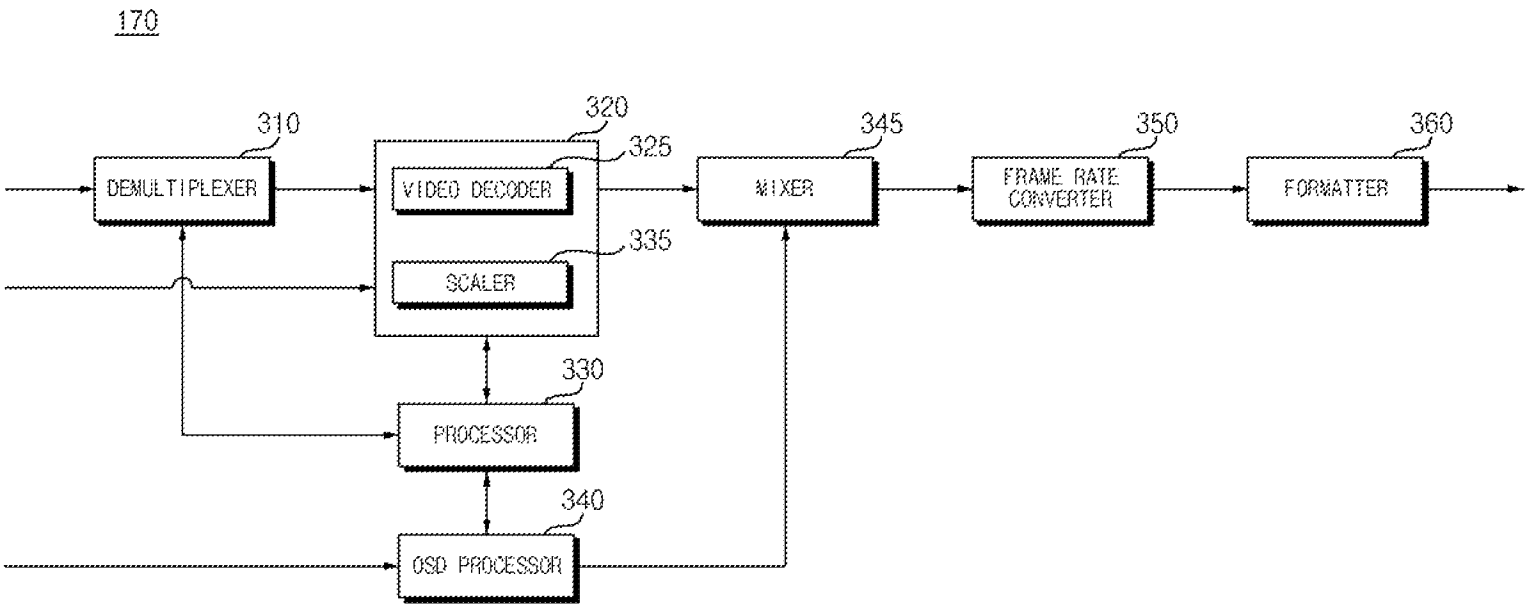
FIG. 4 is an internal block diagram of the signal processor of FIG. 3.

FIG. 4 is an internal block diagram of the signal processor of FIG. 3.

Referring to FIG. 4, the signal processor 170 according to an embodiment of the present disclosure includes a demultiplexer 310, a video processor 320, a processor 330, an OSD processor 340, a mixer 345, a frame rate converter 350, and a formatter 360. In addition, the processor 170 may further include an audio processor (not shown) and a data processor (not shown).

The demultiplexer 310 demultiplexes an input stream. For example, the demultiplexer 310 may demultiplex an MPEG-2 TS into a video signal, an audio signal, and a data signal. Here, the stream signal input to the demultiplexer 310 may be a stream signal output from the tuner module 110, the demodulator 120, or the external device interface 130.

The video processor 320 may process the demultiplexed video signal. To this end, the video processor 320 may include a video decoder 325 and a scaler 335.

The video processor 325 decodes the demultiplexed video signal, and the scaler 335 scales resolution of the decoded video signal so that the video signal may be displayed on the display 180.

The video decoder 325 may include decoders of various standards. Examples of the video decoder 325 may include an MPEG-2 decoder, an H.264 decoder, a 3D video decoder for decoding a color image and a depth image, a decoder for decoding an image having a plurality of viewpoints, and the like.

The processor 330 may control the overall operation of the image display apparatus 100 or the signal processor 170. For example, the processor 330 controls the tuner module 110 to tune to an RF signal corresponding to a channel selected by the user or a previously stored channel.

The processor 330 may control the image display apparatus 100 by a user command input through the user input interface 150 or an internal program.

Further, the processor 330 may control data transmission of the network interface 135 or the external device interface 130.

In addition, the processor 330 may control the operation of the demultiplexer 310, the video processor 320, the OSD processor 340 of the signal processor 170, and the like.

The OSD processor 340 generates an OSD signal autonomously or according to user input. For example, the OSD processor 340 may generate signals by which various types of information are displayed as graphics or text on the display 180 according to a user input signal. The generated OSD signal may include various data such as a User Interface (UI), various menus, widgets, icons, etc. Further, the generated OSD signal may include a 2D object or a 3D object.

The OSD processor 340 may generate a pointer which can be displayed on the display according to a pointing signal received from the remote signal processor 200. Particularly, such pointer may be generated by a pointing signal processor, and the OSD processor 340 may include such pointing signal processor (not shown). Alternatively, the pointing signal processor (not shown) may be provided separately from the OSD processor 340 without being included therein.

The mixer 345 may mix the OSD signal generated by the OSD processor 340 and the decoded video signal processed by the video processor 320. The mixed video signal is provided to the frame rate converter 350.

The frame rate converter (FRC) 350 may convert a frame rate of an input video. The frame rate converter 350 may output the input video as it is without converting the frame rate.

The formatter 360 may convert the format of a video signal. For example, the formatter 360 may convert the format of a 3D image signal into any one of various 3D formats, such as a side-by-side format, a top-down format, a frame sequential format, an interlaced format, a checker box format, and the like.

The audio processor (not shown) in the signal processor 170 may process the demultiplexed audio signal, or an audio signal of a predetermined content. To this end, the audio processor 370 may include various decoders.

Further, the audio processor (not shown) in the signal processor 170 may also adjust the bass, treble, or volume of the audio signal.

A data processor (not shown) in the signal processor 170 may process the demultiplexed data signal. For example, when the demultiplexed data signal is encoded, the data processor may decode the encoded demultiplexed data signal. Here, the encoded data signal may be Electronic Program Guide (EPG) information including broadcast information such as the start time and end time of a broadcast program which is broadcast through each channel.

The block diagram of the signal processor 170 illustrated in FIG. 4 is by example. The components of the block diagrams may be integrated or omitted, or a new component may be added according to the specifications of the signal processor 170.

Particularly, the frame rate converter 350 and the formatter 360 may not be included in the signal processor 170 but may be provided individually, or may be provided separately as one module.

Figure 5A:
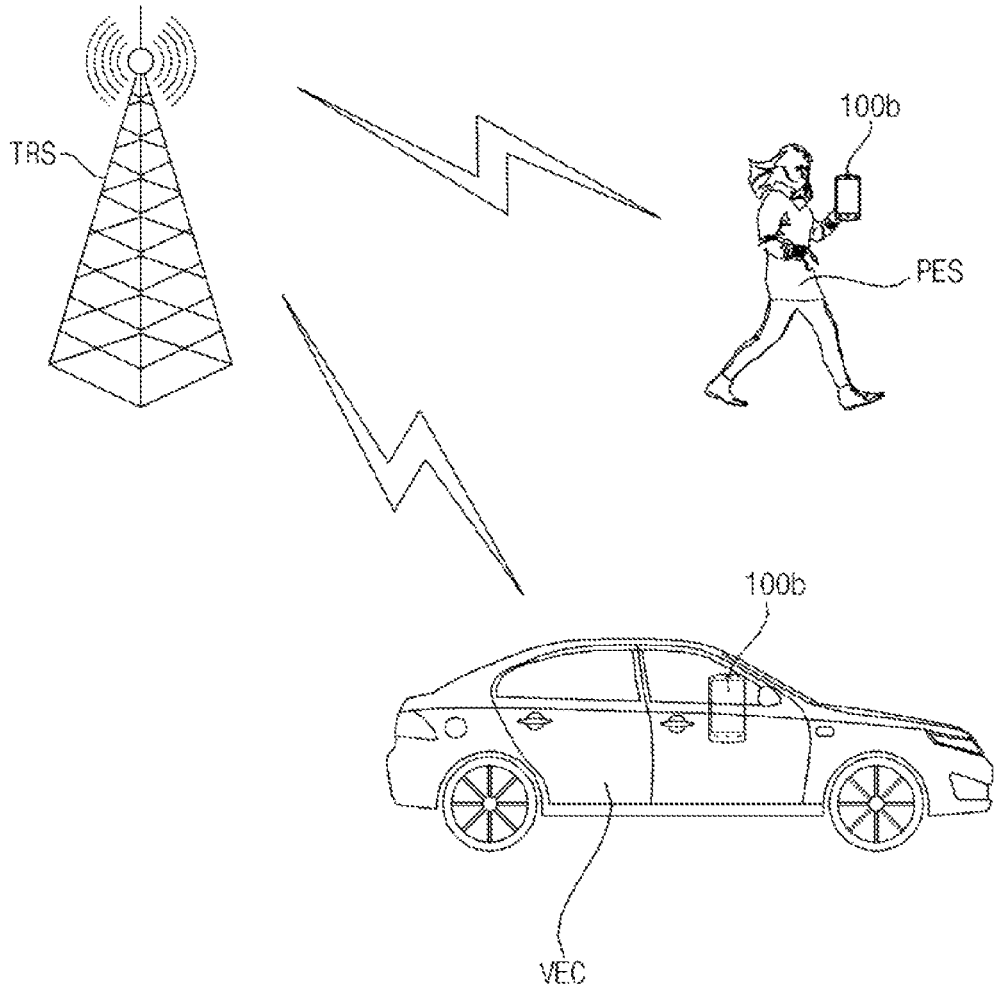
FIGS. 5A to 5B are diagrams for explaining a static channel and a mobile channel.
Figure 5B:
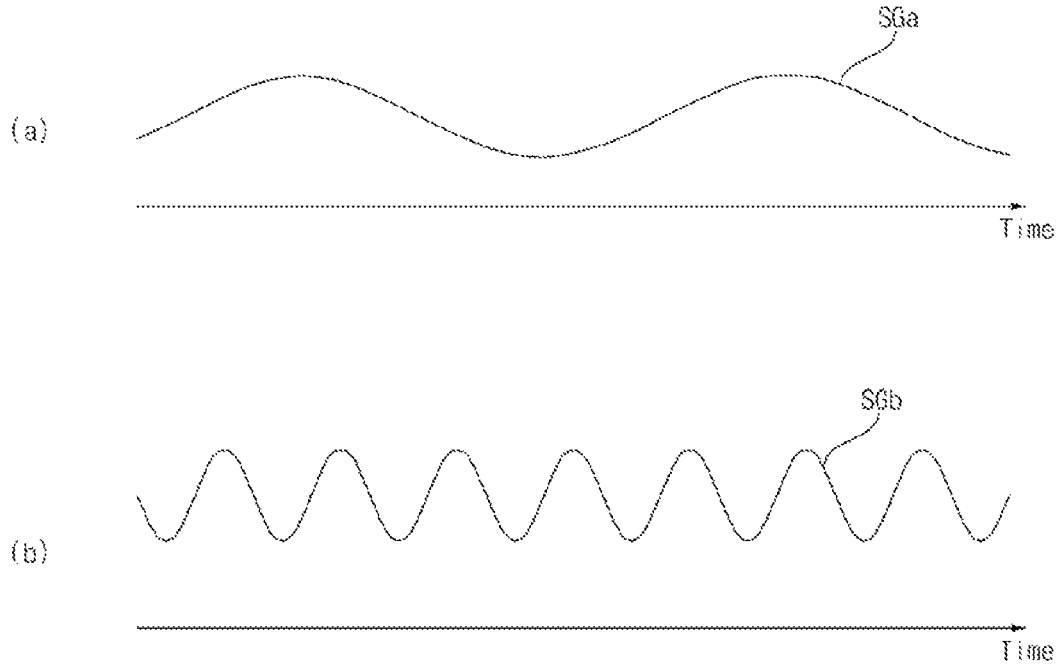

FIGS. 5A to 5B are diagrams for explaining a static channel and a mobile channel.

First, FIG. 5A illustrates an example in which an RF signal output from a base station TRS is received by a mobile terminal 100*b* of a pedestrian PES or is received by the mobile terminal 100*b* inside a vehicle VEC.

The mobile terminal 100*b* of the pedestrian PES may receive the RF signal through a static channel, and the mobile terminal 100*b* inside the vehicle VEC may receive the RF signal through a mobile channel.

(a) of FIG. 5B is a diagram illustrating an example of a Doppler frequency signal SGa in a static channel. (b) of FIG. 5B is a diagram illustrating an example of a Doppler frequency signal SGb in a mobile channel.

As shown in FIG. 5B, the frequency of the Doppler frequency signal SGb in the mobile channel is higher than the frequency of the Doppler frequency signal SGa in the static channel.

For example, when the moving speed of the pedestrian PES of FIG. 5A is about 4 Km/h, the RF signal may correspond to the Doppler frequency signal SGa in the static channel, as shown in (a) of FIG. 5B, and when the moving speed of the vehicle VEC of FIG. 5A is about 80 Km/h, the RF signal may correspond to the Doppler frequency signal SGb in the mobile channel, as shown in (b) of FIG. 5B.

Figure 6A:
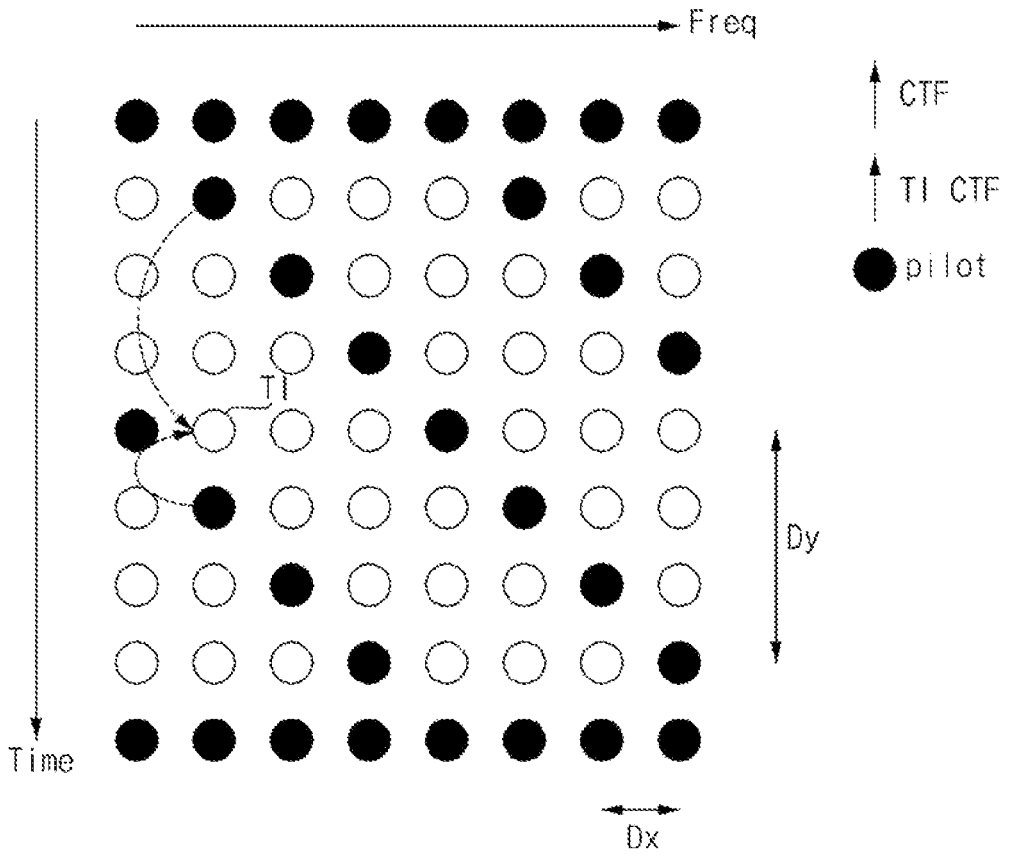
FIGS. 6A to 6C are diagrams for explaining interpolation based on a pilot signal.

FIG. 6A is a diagram for explaining interpolation in the frequency domain and the time domain when an RF signal is an RF signal based on an orthogonal frequency-division multiplexing (OFDM) method.

Referring to FIG. 6A, when a pilot signal is extracted from the RF signal, the pilot signal may be indicated in a pilot pattern in the frequency domain on the horizontal axis and in the time domain on the vertical ax.

The signal processing device 520 may perform frequency interpolation in the horizontal direction and time interpolation in the vertical direction based on the pilot signal or the pilot pattern.

The signal processing device 520 may acquire an effective symbol or effective data in the RF signal based on this interpolation or the like.

The mobile channel detected by the signal processing device 520 may correspond to a channel that is changed over time due to the Doppler frequency (Doppler speed).

In this case, the channel is changed more over time as the Doppler frequency increases, and thus a channel change between symbols on the time axis in an OFDM symbol may be increased.

The signal processing device 520 may determine a channel change over time using a channel transfer function value of a pilot symbol positioned at an interval dy of the time axis in an OFDM symbol.

Figure 6B:
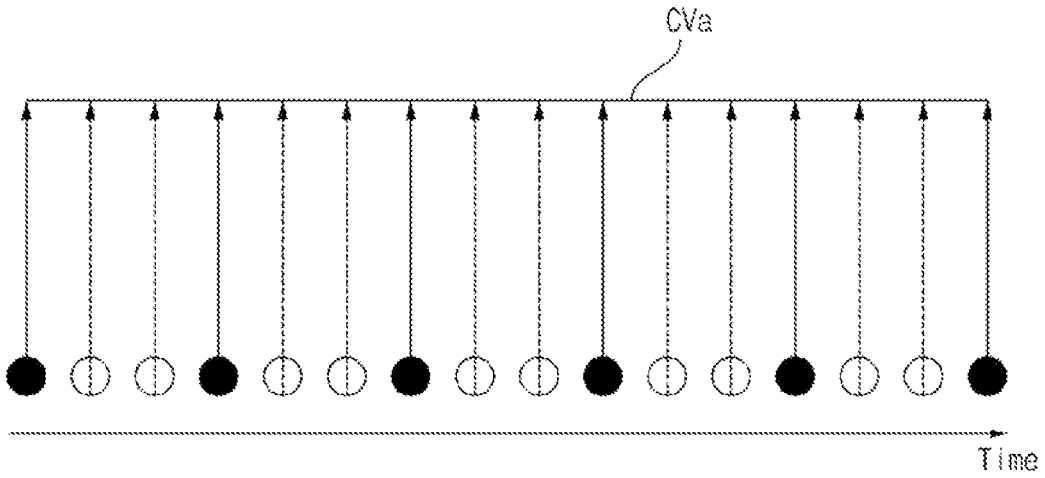

FIG. 6B is a diagram showing an example of time interpolation in a static channel.

Referring to FIG. 6B, the signal processing device 520 may restore a signal CVa corresponding to the static channel by performing time interpolation based on the pilot signal or the pilot pattern.

Figure 6C:
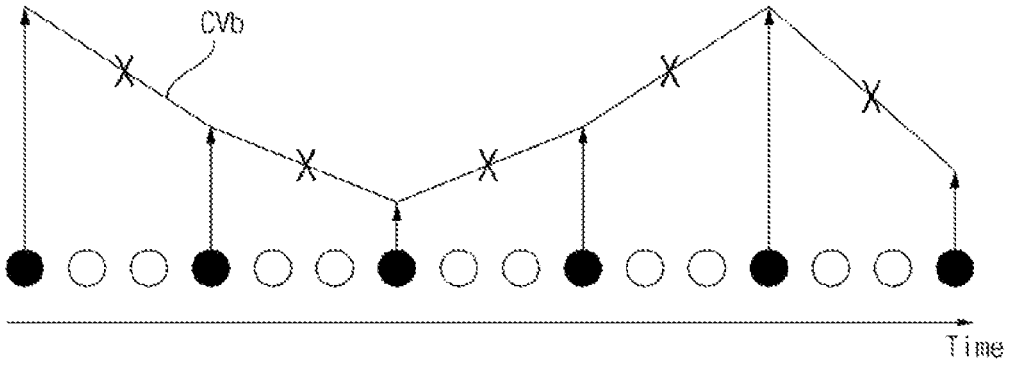

FIG. 6C is a diagram showing an example of time interpolation in a mobile channel.

Referring to FIG. 6C, the signal processing device 520 may restore a signal CVb corresponding to the mobile channel by performing time interpolation based on the pilot signal or the pilot pattern.

In this case, in the mobile channel, when time interpolation is performed, it may be difficult to accurately restore a signal, and accuracy may be remarkably lowered. Thus, in the mobile channel, time interpolation may not be performed.

Figure 7A:
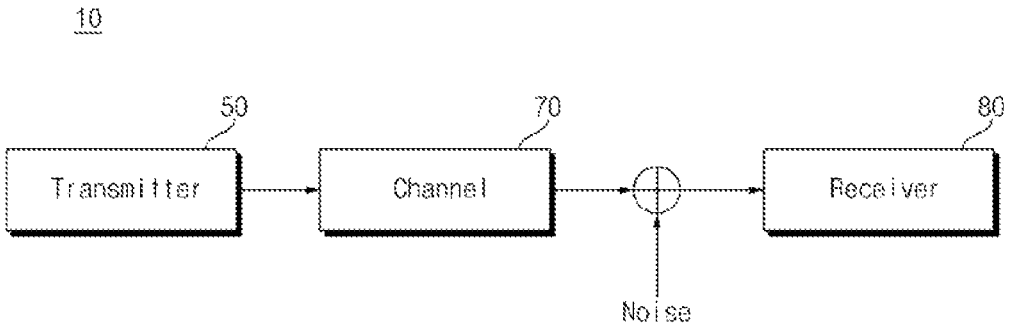
FIG. 7A is a block diagram illustrating an RF signal receiving system according to an embodiment of the present disclosure.

FIG. 7A is a block diagram illustrating an RF signal receiving system according to an embodiment of the present disclosure.

Referring to FIG. 7A, the RF signal receiving system 10 according to an embodiment of the present disclosure may include the wireless signal transmitting device 50 for transmitting an RF signal CA and the wireless reception device 80 for receiving the RF signal CA.

A noise signal from a channel 70 may be added to the RF signal CA transmitted by the wireless signal transmitting device 50, and the wireless reception device 80 may receive the RF signal CA, to which the noise signal is added.

Figure 7B:
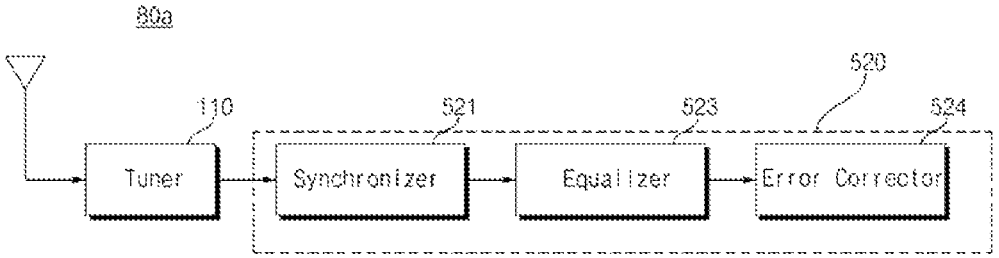
FIG. 7B is a block diagram illustrating an example of a wireless reception device according to an embodiment of the present disclosure.

FIG. 7B is a block diagram illustrating an example of a wireless reception device according to an embodiment of the present disclosure.

Referring to FIG. 7B, a wireless reception device 80*a* according to an embodiment of the present disclosure may include the tuner module 110 for receiving an RF signal including channel noise and converting the RF signal into a baseband signal, and the signal processing device 520 for performing signal processing on the baseband signal.

In this case, the tuner module 110 may also function as a demodulator. Alternatively, the wireless reception device 80*a* may also function as the demodulator of FIG. 2.

The signal processor 520 according to an embodiment of the present disclosure may include the synchronizer 521, the equalizer 523, an error corrector 524, and the like. The synchronizer 521 may perform synchronization based on an input baseband signal.

The synchronizer 521 may perform synchronization based on a mean squared error (MSE).

For example, the synchronizer 521 may perform synchronization based on a mean squared error (MSE) and may perform synchronization again based on an updated mean squared error (MSE).

The signal processing device 520 may calculate an error e, which is a difference between the input baseband signal and a pilot signal, which is a reference signal, and may output a mean squared error (MSE) based on the calculated error e.

The equalizer 523 may perform equalization based on the signal synchronized by the synchronizer 521.

The equalizer 523 may perform synchronization based on a mean squared error (MSE).

For example, the equalizer 523 may perform synchronization based on a mean squared error (MSE) and may perform synchronization again based on an updated mean squared error (MSE).

The equalizer 523 may perform channel equalization using channel information while performing equalization.

The equalizer 523 may perform interference estimation or channel estimation based on the signal synchronized by the synchronizer 521.

The equalizer 523 may perform interference estimation or channel estimation based on a mean squared error (MSE).

For example, the equalizer 523 may perform interference estimation or channel estimation based on a mean squared error (MSE), and may perform interference estimation or channel estimation based on an updated mean squared error (MSE).

The equalizer 523 may estimate that a communication channel or a broadcast channel includes any one of interference including co-channel interference, adjacent-channel interference, single-frequency interference, burst noise, and phase noise.

The equalizer 523 may also estimate a communication channel or a broadcast channel as any one of a static channel, a mobile channel, and the like.

The static channel may include a Rayleigh channel, a Rician channel, and the like, and the mobile channel may include a vehicular channel, a Doppler channel, and the like.

The error corrector 524 may perform error correction based on the signal (equalization signal) equalized by the equalizer 523. In particular, the error corrector 524 may perform forward error correction.

In this case, the mean squared error (MSE) may be performed based on the signal from the equalizer 523.

The error corrector 524 may perform error correction based on the optimized mean squared error (MSE), thereby accurately performing error correction.

The error corrector 524 may accurately perform error correction even in the presence of interference related to burst noise.

The error corrector 524 may accurately perform error correction in consideration of the fact that the communication channel is a static channel.

The error corrector 524 may accurately perform error correction in consideration of the fact that the communication channel is a mobile channel.

Figure 7C:
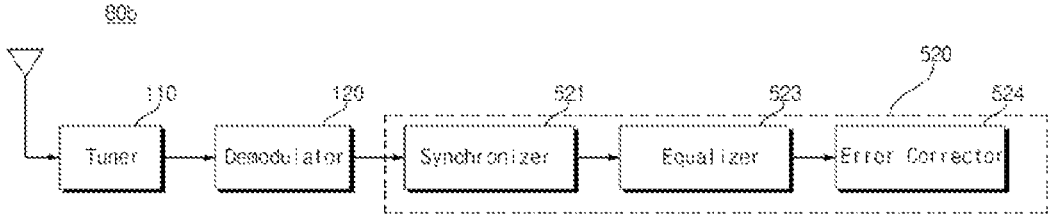
FIG. 7C is a block diagram illustrating an example of a wireless reception device according to another embodiment of the present disclosure.

FIG. 7C is a block diagram illustrating an example of a wireless reception device according to another embodiment of the present disclosure.

Referring to FIG. 7C, a wireless reception device 80*b* of FIG. 7C may be similar to the wireless reception device 80 of FIG. 7B, but may be different therefrom in that the demodulator 120 is further included between the tuner module 110 and the signal processing device 520.

The tuner module 110 of FIG. 7C may receive an RF signal including channel noise and may convert the RF signal into an intermediate frequency signal, and the demodulator 120 may convert the intermediate frequency signal into a baseband signal.

The signal processing device 520 may perform signal processing on the baseband signal from the demodulator 120, as described with reference to FIG. 7B.

Figure 8A:
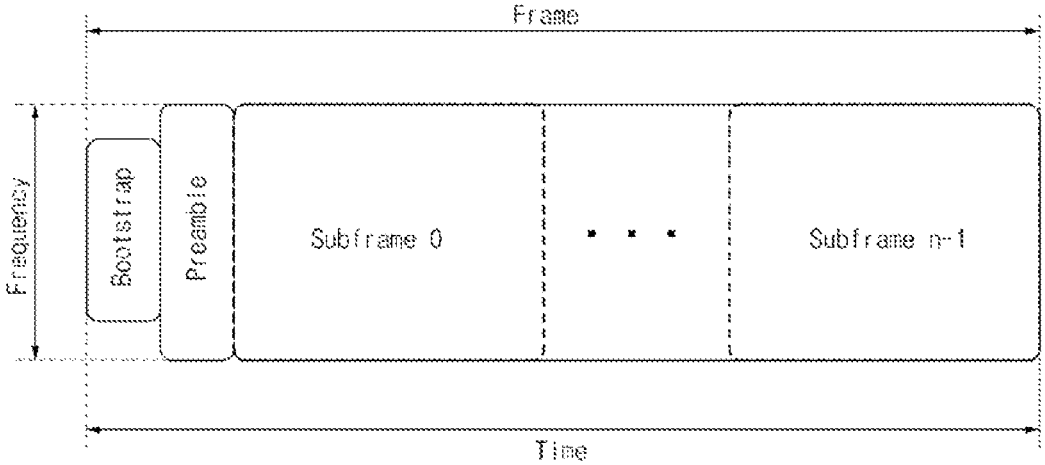
FIG. 8A is a diagram showing the configuration of a frame according to the ATSC 3.0 standard.

FIG. 8A is a diagram showing the configuration of a frame according to the ATSC 3.0 standard.

Referring to FIG. 8A, frame data according to the ATSC 3.0 standard may include bootstrap data, preamble data, a plurality of pieces of subframe data (subframe 0, . . . subframe n−1).

Figure 8B:
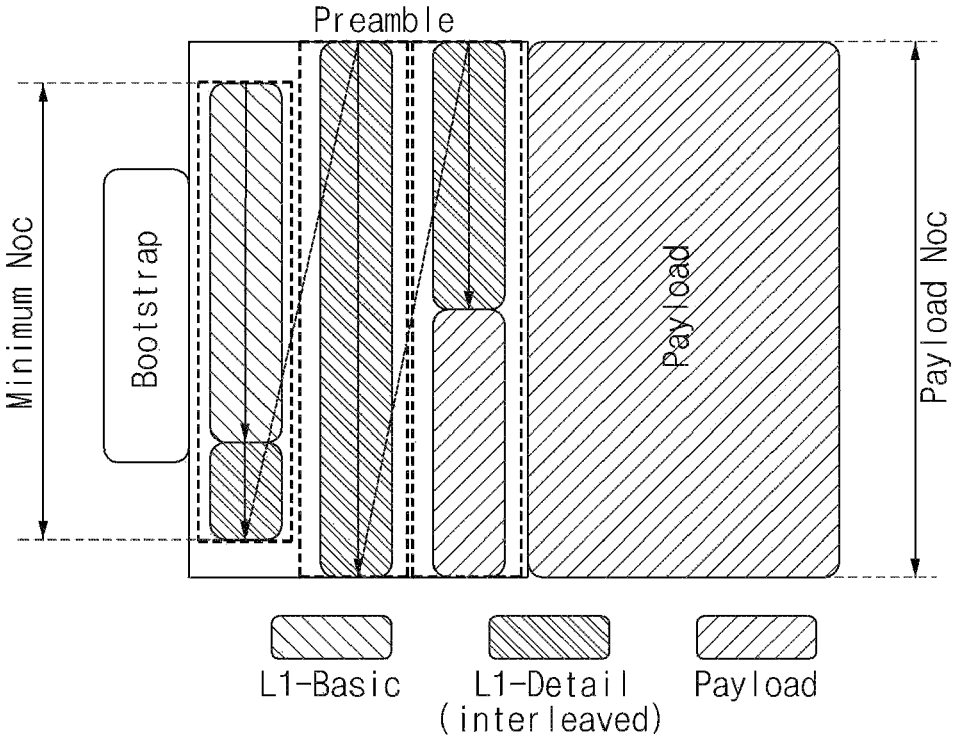
FIG. 8B is a diagram showing an example of basic signaling data and detailed signaling data of the preamble data of FIG. 8A.

FIG. 8B is a diagram showing an example of basic signaling data and detailed signaling data of the preamble data of FIG. 8A.

Referring to FIG. 8B, the preamble data according to the ATSC 3.0 standard may include L1 basic signaling data and L1 detailed signaling data.

Payload data may be indicated after the preamble data according to the ATSC 3.0 standard.

The amount of the L1 detailed signaling data may be higher than the L1 basic signaling data.

In particular, the amount of the L1 basic signaling data may be smaller than information on the minimum number of carriers (minimum NOC).

The amount of the L1 detailed signaling data may be greater than information on the minimum number of carriers (minimum NOC).

According to the ATSC 3.0 standard of FIGS. 8A and 8B, decoding of bootstrap data needs to be structurally completed in order to decode the L1 basic signaling data.

In particular, the L1 basic signaling data may include information required to decode the L1 detailed signaling data and information on a parameter required to process data of a first subframe.

The L1 detailed signaling data may include information on a parameter required to process data after a second subframe.

Figure 9:
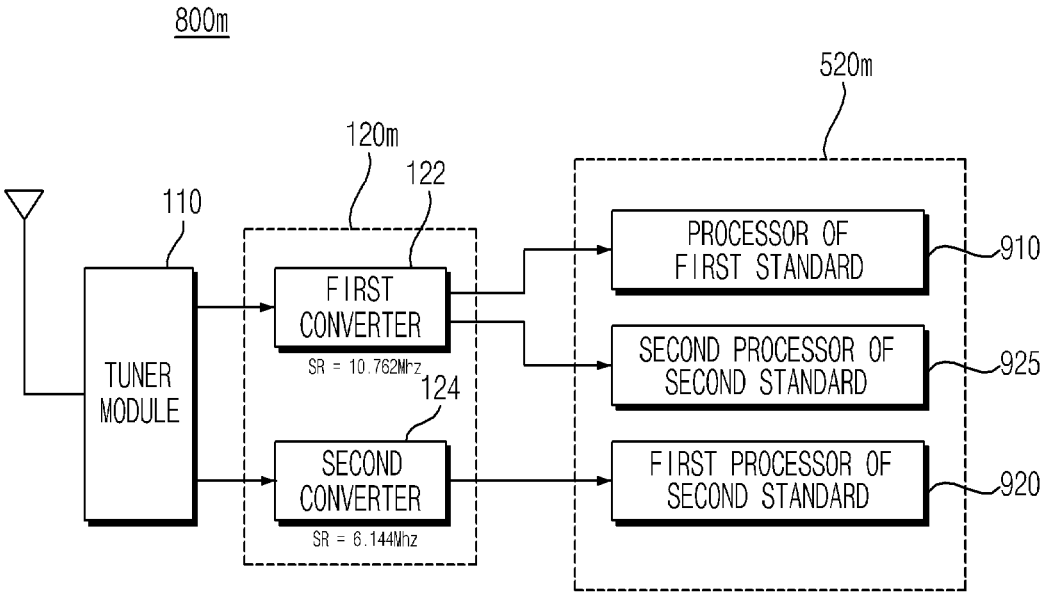
FIG. 9 is an internal block diagram showing an example of a wireless reception device according to an embodiment of the present disclosure.

FIG. 9 is an internal block diagram showing an example of a wireless reception device according to an embodiment of the present disclosure.

Referring to FIG. 9, the wireless reception device 800*m* according to an embodiment of the present disclosure may include the first signal converter 122 for converting an input signal based on a RF signal into the first baseband signal, the second signal converter 124 for converting the input signal based on the RF signal into the second baseband signal, the processor 910 of the first standard for performing signal processing on the first baseband signal from the first signal converter 122 based on the first standard, and the first processor 920 of the second standard for performing signal processing on the second baseband signal from the second signal converter 124 based on the second standard.

According to an embodiment of the present disclosure, when standard of the input signal based on the RF signal is not detected, the processor 910 of the first standard may perform signal processing on the first baseband signal from the first signal converter 122 based on the first standard during a first period, and the first processor 920 of the second standard may perform signal processing on the second baseband signal from the second signal converter 124 based on the second standard during the first period, when the standard of the input signal is detected by the signal processing during the first period, the first signal converter 122 may output a baseband signal of the first standard or a baseband signal of the second standard based on the detected standard during a second period after the first period.

Accordingly, the time delay when signal processing is performed on input signals of a plurality of standards may be reduced. In particular, it is possible to reduce the time delay during signal processing when the standard of the input signal is not detected. The wireless reception device 800*m* may further include a second processor 925 of the second standard for performing signal processing based on a third baseband signal from the first signal converter 122. Accordingly, the time delay when signal processing is performed on the second input signal of the second standard may be reduced.

The wireless reception device 800*m* according to an embodiment of the present disclosure may include the tuner module 110 for receiving an RF signal, a signal conversion device 120*m* for converting the input signal from the tuner module 110 into a baseband signal, and a signal processing device 520*m* for processing a baseband signal from the signal conversion device 120*m*.

The signal conversion device 120*m* may include the first signal converter 122, for converting the input signal based on the RF signal into the first baseband signal, and the second signal converter 124, for converting the input signal based on the RF signal into the second baseband signal.

The signal processing device 520*m* may include the processor 910 of the first standard for performing signal processing on the first baseband signal based on the first standard, the first processor 920 of the second standard for performing signal processing on the second baseband signal from the second signal converter 124 based on the second standard, and the second processor 925 of the second standard for performing signal processing based on a third baseband signal from the first signal converter 122.

The wireless reception device 800*m* according to another embodiment of the present disclosure may include the first signal converter 122 for converting the input signal based on the RF signal into the first baseband signal, the second signal converter 124 for converting the input signal based on the RF signal into the second baseband signal, the processor 910 of the first standard for performing signal processing on the first baseband signal from the first signal converter 122 based on the first standard, and the first processor 920 of the second standard for performing signal processing on the second baseband signal from the second signal converter 124 based on the second standard, and in this case, when standard of the input signal based on the RF signal is not detected, the processor 910 of the first standard and the first processor 920 of the second standard do not sequentially operate with each other, and the processor 910 of the first standard and the first processor 920 of the second standard may perform respective signal processing operations simultaneously.

Accordingly, the time delay when signal processing is performed on input signals of a plurality of standards may be reduced. In particular, it is possible to reduce the time delay during signal processing when the standard of the input signal is not detected.

Figure 13:
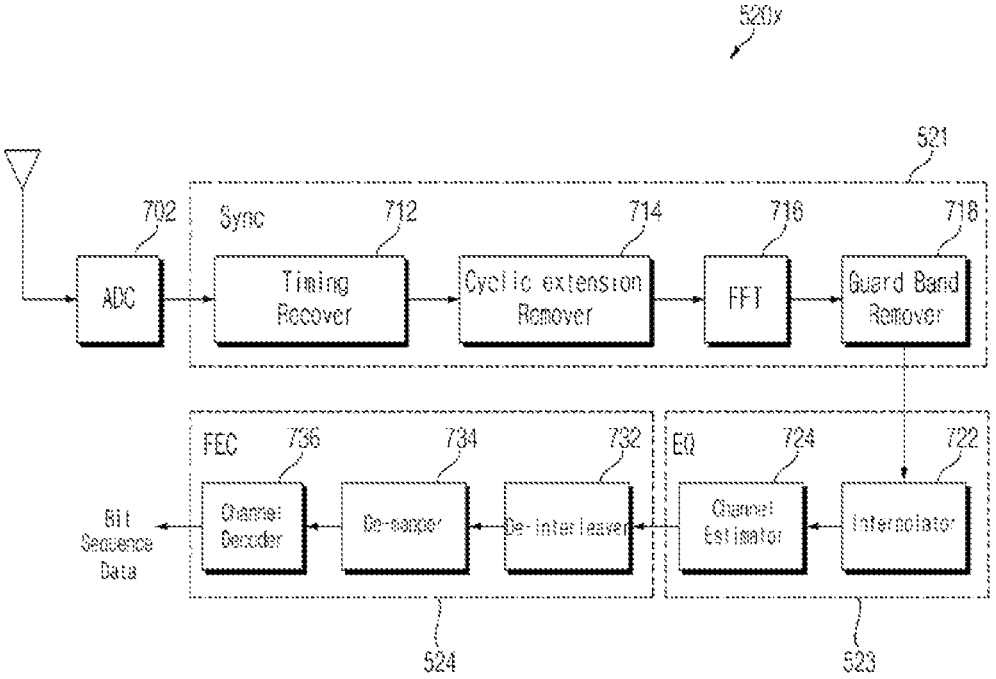
FIG. 13 is an internal block diagram showing an example of a signal processing device according to an embodiment of the present disclosure.
Figure 14:
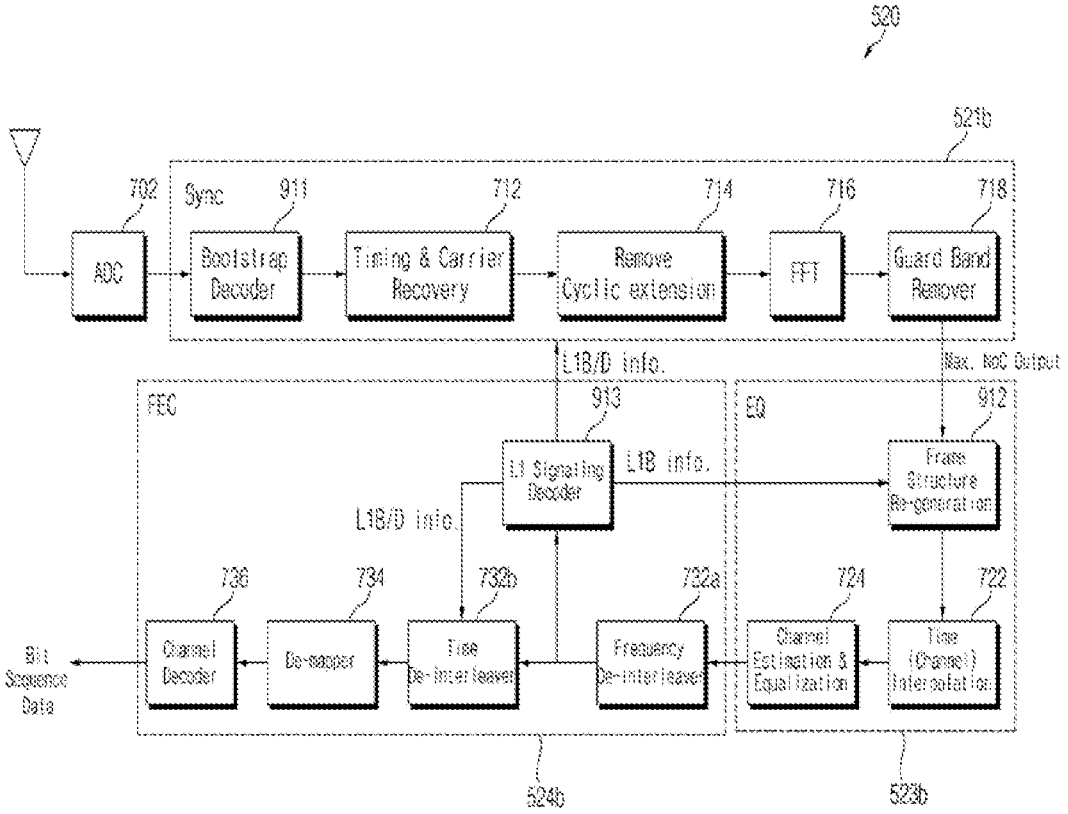
FIG. 14 is an internal block diagram showing an example of a signal processing device according to another embodiment of the present disclosure.

The signal processing device 520*m* of FIG. 9 may be embodied as the signal processing device of FIG. 13 or 14.

For example, the first processor 920 of the second standard in the signal processing device 520*m* of FIG. 9 may correspond to a bootstrap decoder 911 in the synchronizer 521*b* of FIG. 14.

The second processor 925 of the second standard in the signal processing device 520*m* of FIG. 9 may correspond to a signaling decoder 913 in the error corrector 524*b* of FIG. 14.

Figure 10A:
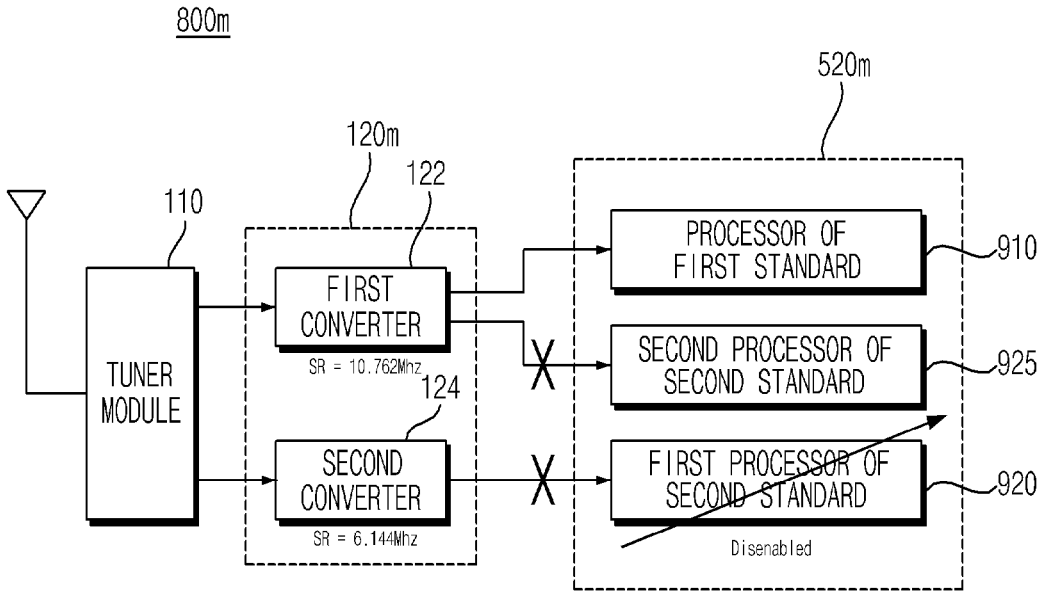
FIGS. 10A to 10C are diagrams for explaining an operation of a wireless reception device related to the present disclosure.
Figure 10B:
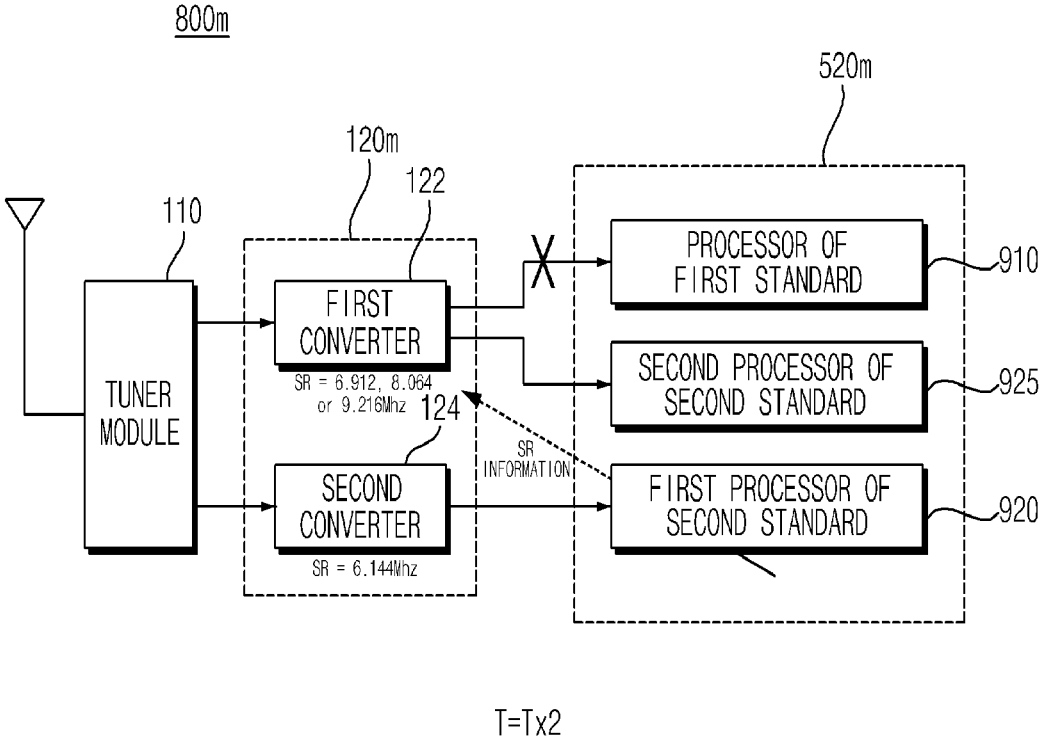
Figure 10C:
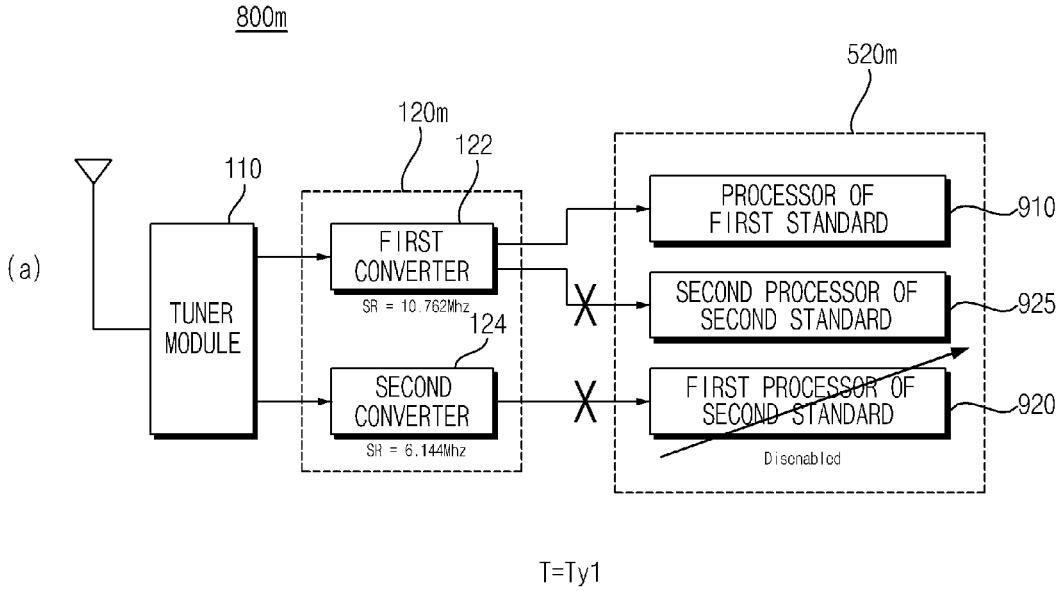
Figure 10C:
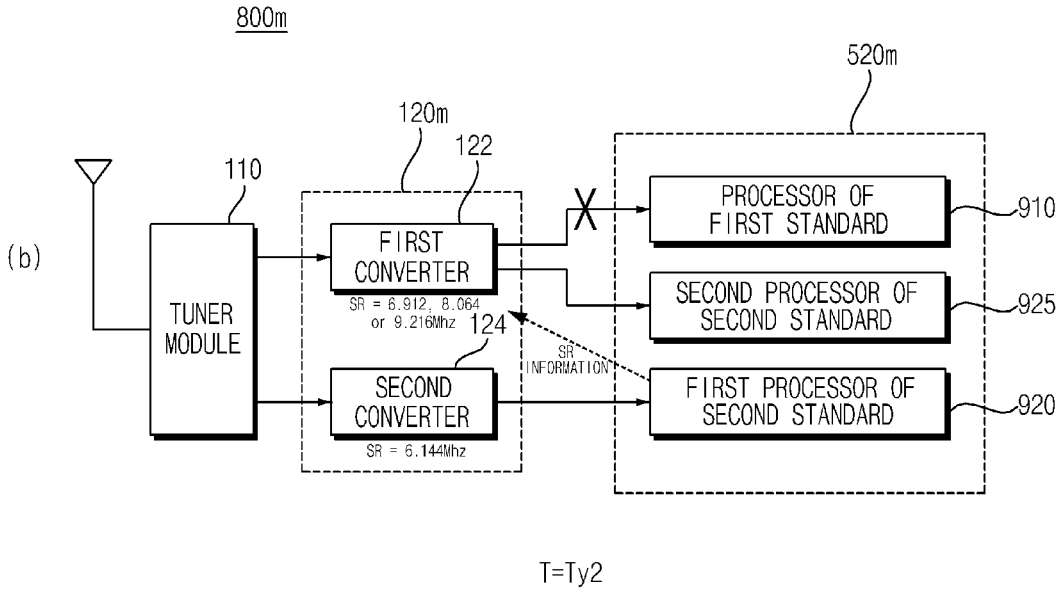

FIGS. 10A to 10C are diagrams for explaining an operation of a wireless reception device related to the present disclosure.

FIG. 10A shows an example in which a wireless reception device receives the first input signal of the first standard.

Here, the first signal converter 122 in the signal conversion device 120*m* may convert the first input signal of the first standard into the first baseband signal and output the converted signal, and the processor 910 of the first standard may receive the first baseband signal and may perform signal processing on the received first baseband signal.

In this case, the second signal converter 124, the first processor 920 of the second standard, and the second processor 925 of the second standard may not be operated.

A signal processing time period of the first input signal according to the first standard in FIG. 10A may be about Tx1.

FIG. 10B shows an example in which a wireless reception device receives the second input signal of the second standard.

Here, the second signal converter 124 in the signal conversion device 120*m* may convert the second input signal of the second standard into the second baseband signal, and the first processor 920 of the second standard may receive the second baseband signal and may perform signal processing thereon.

The first processor 920 of the second standard may output sample rate information, obtained via signal processing, to the first signal converter 122.

Thus, based on the sample rate information from the first processor 920 of the second standard, the second input signal of the second standard may be converted into the third baseband signal.

The second processor 925 of the second standard may perform signal processing based on the third baseband signal from the first signal converter 122.

The first processor 920 of the second standard may decode bootstrap data, and the second processor 925 of the second standard may decode preamble data and subframe data.

The processor 910 of the first standard may not be operated.

The signal processing time period of the second input signal of the second standard in FIG. 10B may be about Tx2.

FIG. 10C shows an example in which a wireless reception device does not detected standard of the input signal based on the RF signal.

Referring to FIG. 10C, first, the first signal converter 122 in the signal conversion device 120*m* may convert the first input signal of the first standard into the first baseband signal, and the processor 910 of the first standard may receive the first baseband signal and may perform signal processing on the received first baseband signal.

In this case, the second signal converter 124, the first processor 920 of the second standard, and the second processor 925 of the second standard may not be operated.

The signal processing time period of the first input signal of the first standard in FIG. 10C may be about Ty1.

After performing signal processing on the first input signal of the first standard, the second signal converter 124 in the signal conversion device 120*m* may convert the second input signal of the second standard into the second baseband signal and output the converted second baseband signal, and the first processor 920 of the second standard may receive the second baseband signal and may perform signal processing on the received second baseband signal.

The first processor 920 of the second standard may output sample rate information, obtained via signal processing, to the first signal converter 122.

Accordingly, based on the sample rate information from the first processor 920 of the second standard, the second input signal of the second standard may be converted into the third baseband signal.

The second processor 925 of the second standard may perform signal processing based on the third baseband signal from the first signal converter 122.

A signal processing time period of the second input signal of the second standard in FIG. 10C may be about Ty2.

As a result, as shown in FIG. 10C, in the state in which standard of the input signal based on the RF signal is not detected, when signal processing is first performed based on the first standard, and then signal processing is performed based on the second standard, the total signal processing time period for the second standard may increase to Ty1+Ty2. In particular, Ty1 time is unnecessary.

Accordingly, the present disclosure proposes a method of reducing a time delay during signal processing when standard of the input signal based on the RF signal is not detected, which will be described below with reference to FIG. 11 and the following drawings.

Figure 11:
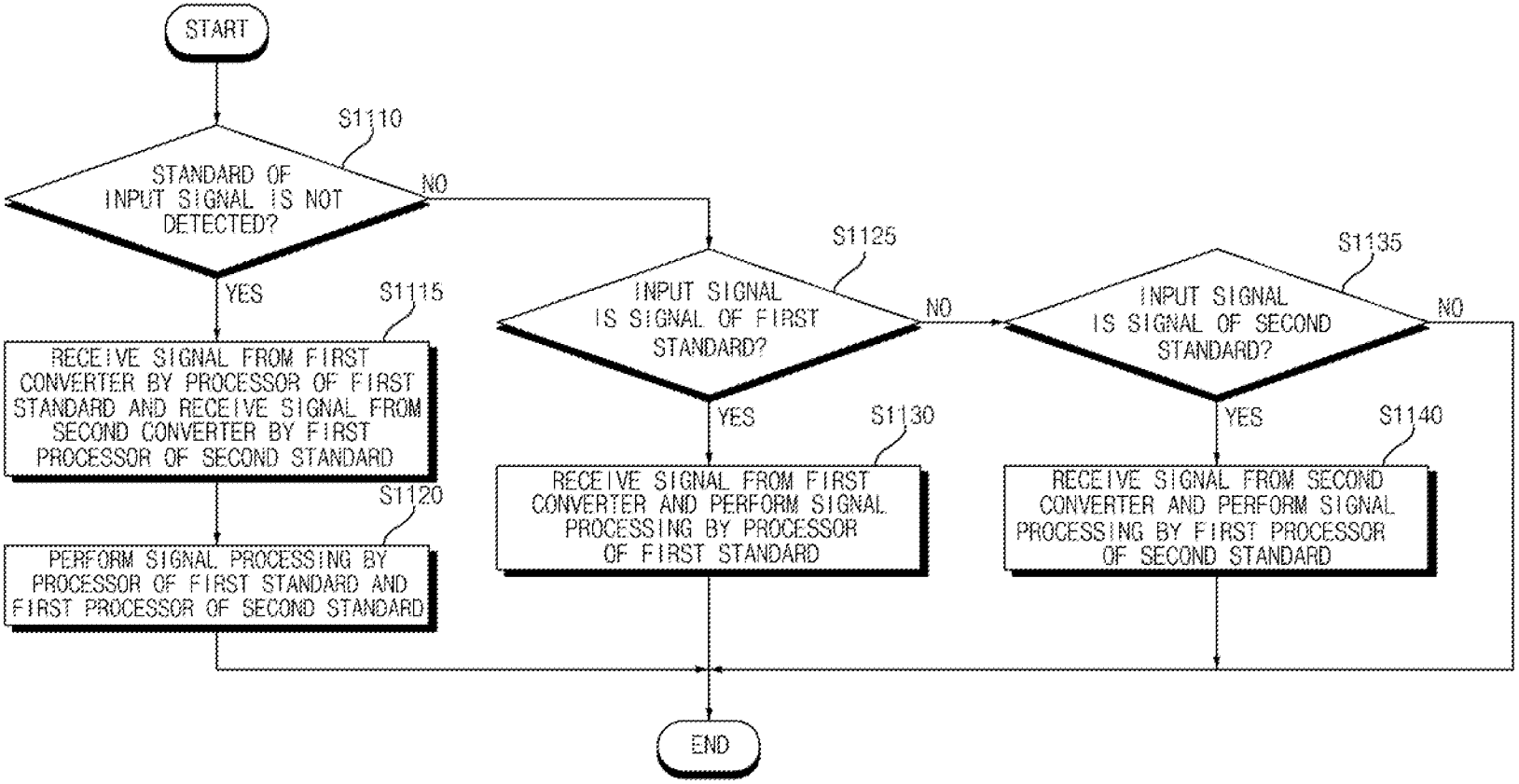
FIG. 11 is a flowchart showing an operation method of a wireless reception device according to an embodiment of the present disclosure.
Figure 12A:
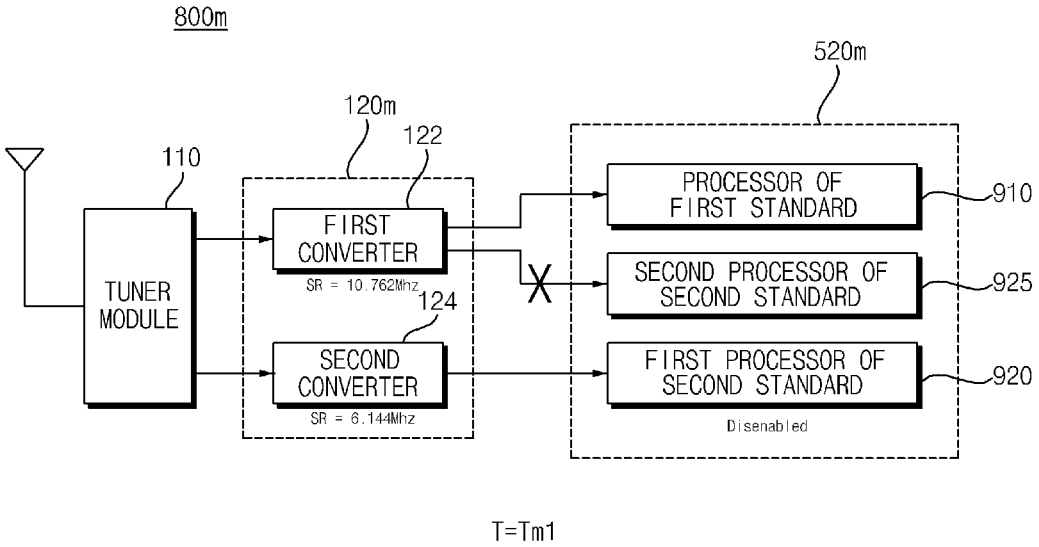
FIGS. 12A to 12C are diagrams for explaining the operation method of FIG. 11.
Figure 12B:
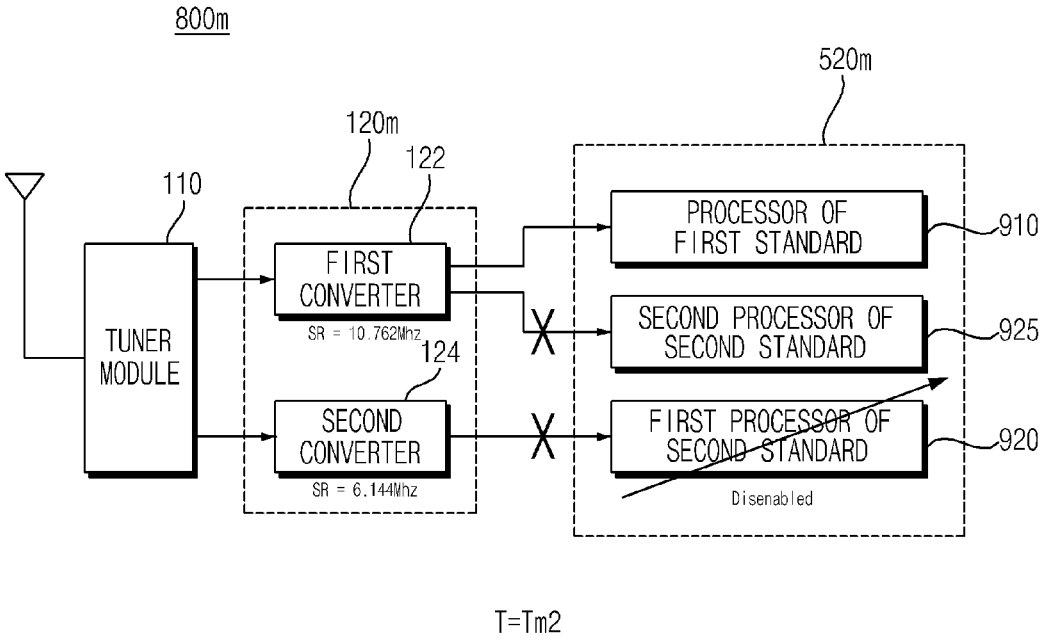
Figure 12C:
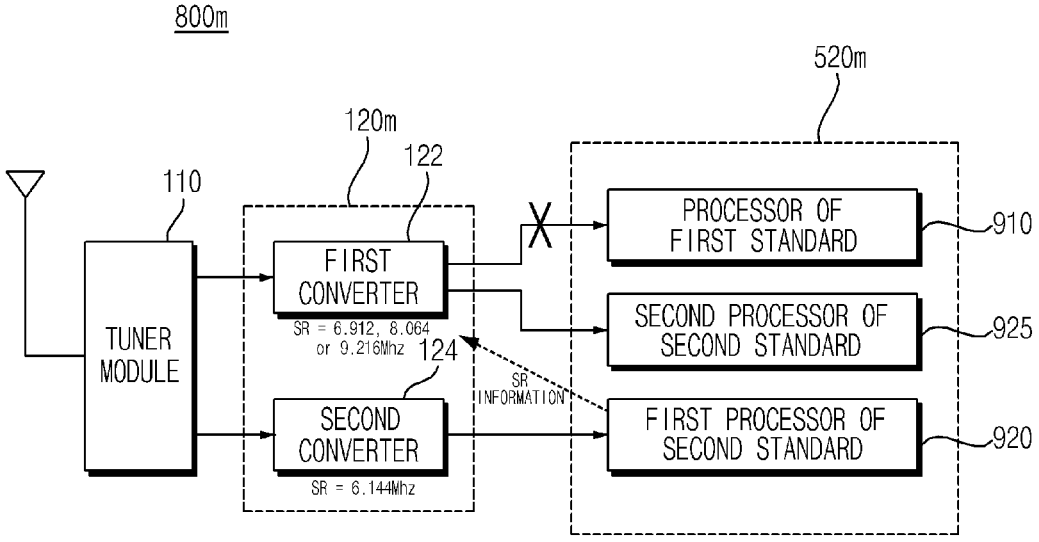

FIG. 11 is a flowchart showing an operation method of a wireless reception device according to an embodiment of the present disclosure. FIGS. 12A to 12C are diagrams for explaining the operation method of FIG. 11.

Referring to the drawings, the signal conversion device 120*m* in the wireless reception device 800*m* may check the standard of an input signal.

For example, the signal conversion device 120*m* in the wireless reception device 800*m* may check whether standard of the input signal based on the RF signal is not detected (S1110).

For example, as shown in FIG. 12A, when standard of the input signal based on the RF signal is not detected, the first input signal may be input to the first signal converter 122, and the second input signal may be input to the second signal converter 124.

Thus, the first signal converter 122 may convert the first input signal of the first standard into the first baseband signal of a first sample rate, and the second signal converter 124 may convert the second input signal of the second standard into the second baseband signal of a second sample rate.

The sample rate of the first baseband signal output from the first signal converter 122 and the sample rate of the second baseband signal output from the second signal converter 124 may be different from each other. In particular, the first sample rate may be higher than the second sample rate.

For example, the first sample rate may be 10.762 MHz, and the second sample rate may be 6.144 MHz.

Then, the processor 910 of the first standard may receive the first baseband signal from the first signal converter 122, and the first processor 920 of the second standard may receive the second baseband signal from the second signal converter 124 (S1115).

The processor 910 of the first standard and the first processor 920 of the second standard may simultaneously perform signal processing (S1120).

For example, the processor 910 of the first standard may perform signal processing on the first baseband signal from the first signal converter 122 based on the first standard, and simultaneously, the first processor 920 of the second standard may perform signal processing on the second baseband signal from the second signal converter 124 based on the second standard.

That is, unlike FIG. 10C, the processor 910 of the first standard and the first processor 920 of the second standard do not sequentially operate with each other, and the processor 910 of the first standard and the first processor 920 of the second standard may simultaneously process each signal.

FIG. 12A shows that a signal processing time period of the first input signal and the second input signal may be about Tm1.

As such, when the first input signal and the second input signal are processed using a parallel method, the signal processing time period may be reduced.

The processor 910 of the first standard may determines whether the first input signal corresponds to the first standard.

When the first input signal is detected as a signal corresponding to the first standard, as shown in FIG. 12B, the first signal converter 122 may convert the first input signal of the first standard into the first baseband signal, the processor 910 of a first standard may process the first baseband signal from the first signal converter based on the first standard, and the first processor 920 of a second standard may not operate.

The processor 920 of the second standard may determines whether the second input signal corresponds to the second standard.

When the second input signal is detected as a signal corresponding to the second standard, as shown in FIG. 12C, the processor 920 of the second standard may process and output sample rate information, the second signal converter 124 may convert the second input signal of the second standard into the second baseband signal using sample rate information processed by the first processor 920 of the second standard during the first period.

The second processor 925 of the second standard of FIG. 12A may perform signal processing based on the signal processed by the first processor 920 of the second standard.

The first standard may be the ATSC 1.0 standard, and the second standard may be the ATSC 3.0 standard.

Thus, the first processor 920 of the second standard of FIG. 12A may decode bootstrap data, and the second processor 925 of the second standard may decode preamble data and subframe data.

Then, in operation S1110, when standard of the input signal based on the RF signal is detected and the standard of the input signal corresponds to the first standard (S1125), the first signal converter 122 may convert the first input signal of the first standard into the first baseband signal, and the processor 910 of the first standard may receive the first baseband signal and may perform signal processing on the received first baseband signal (S1130).

FIG. 12B shows an example in which a wireless reception device receives the first input signal of the first standard.

Thus, the first signal converter 122 in the signal conversion device 120*m* may convert the first input signal of the first standard into the first baseband signal, and the processor 910 of the first standard may receive the first baseband signal and may perform signal processing on the received first baseband signal.

In this case, the second signal converter 124, the first processor 920 of the second standard, and the second processor 925 of the second standard may not be operated.

A signal processing time period of the first input signal of the first standard in FIG. 12B may be about Tm2.

Then, when standard of the input signal based on the RF signal is detected and the standard of the input signal corresponds to the second standard (S1135), the first processor 920 of the second standard may receive the second baseband signal from the second signal converter 124 and may perform signal processing on the received second baseband signal (S1140).

FIG. 12C is a diagram showing an example in which a wireless reception device receives the second input signal of the second standard.

Accordingly, the second signal converter 124 in the signal conversion device 120*m* may convert the second input signal of the second standard into the second baseband signal and output the converted second baseband signal, and the first processor 920 of the second standard may receive the second baseband signal and perform signal processing on the received second baseband signal.

The first processor 920 of the second standard may output sample rate, information obtained via signal processing, to the first signal converter 122.

Thus, based on the sample rate information from the first processor 920 of the second standard, the second input signal of the second standard may be converted into the third baseband signal.

The second processor 925 of the second standard may perform signal processing based on the third baseband signal from the first signal converter 122.

The first processor 920 of the second standard may decode bootstrap data, and the second processor 925 of the second standard may decode preamble data and subframe data.

The processor 910 of the first standard may not be operated.

A signal processing time period of the second input signal of the second standard in FIG. 12C may be about Tm3.

When the first signal converter 122 receives the sample rate information, the third baseband signal may have a plurality of sample rates.

FIG. 12C shows an example in which a sample of the third baseband signal is 6.912, 8.064, or 9.215 MHz.

The sample rate of the third baseband signal may be different from the sample rate of the first baseband signal and the sample rate of the second baseband signal.

In particular, the sample rate of the third baseband signal may be smaller than the sample rate of the first baseband signal and may be greater than the sample rate of the third baseband signal.

FIG. 13 is an internal block diagram showing an example of a signal processing device according to an embodiment of the present disclosure.

Referring to FIG. 13, a conventional signal processing device 520*x* may receive a digital signal from an analog digital converter (ADC) 702. In this case, a digital signal may be a baseband signal.

The signal processing device 520*x* may include a synchronizer 521, an equalizer 523, and an error corrector 524.

The synchronizer 521 may include a timing recoverer 712 for performing timing recovery based on the received baseband signal, a cyclic extension remover 714 for removing a cyclic prefix from the signal received from the timing recoverer 712, a FFT processor 716 for performing a fast Fourier transform (FFT) on the signal from the cyclic extension remover 714, and a guard band remover 718 for removing a guard band from the signal received from the FFT processor 716.

The equalizer 523 may include an interpolator 722 for extracting a pilot signal from the signal received from the synchronizer 521, and performing interpolation based on the extracted pilot signal, and a channel estimator 724 for performing channel estimation based on the signal interpolated by the interpolator 722.

Additionally, the error corrector 524 may include a deinterleaver 732 for performing deinterleaving based on a signal of the equalizer 523, a demapper 734 for performing demapping, and a channel decoder 736 for performing channel decoding. Moreover, the error corrector 524 may perform forward error correction and may finally output bit sequence data.

When processing frame data of the ATSC 3.0 standard of FIGS. 8A and 8B, the signal processing device 520*x* shown in FIG. 13 may recognize the number of preambles, the number of subframes, whether a subframe boundary symbol is present, a pilot pattern, or the like, may store only minimum data for decoding the L1 detailed signaling data, may acquire the L1 basic signaling data and the L1 detailed signaling data, and may then process data of a subframe from a second frame.

In order to process the data of the subframe from a first frame, all data need to be stored while the L1 basic signaling data and the L1 detailed signaling data are decoded.

Accordingly, an embodiment of the present disclosure proposes a method of processing payload data of first frame data within a first frame data period Pra or a reception period Pra of first frame data. That is, an embodiment of the present disclosure proposes a method of reducing the time delay when signal processing is performed on input signals of a plurality of standards.

FIG. 14 is an internal block diagram showing an example of a signal processing device according to another embodiment of the present disclosure. FIGS. 15A to 17 are diagrams for explaining an operation of FIG. 14.

First, referring to FIG. 14, a signal processing device 520 according to an embodiment of the present disclosure may receive a digital signal from the analog digital converter (ADC) 702. In this case, the digital signal may be a baseband signal.

The signal processing device 520 according to an embodiment of the present disclosure may include the synchronizer 521*b* for decoding bootstrap data of the first frame data in the received baseband signal, and the error corrector 524*b* including the signaling decoder 913 for decoding basic signaling data of the first frame data.

The signal processing device 520 according to an embodiment of the present disclosure may process payload data of the first frame data within the first frame data period Pra or the reception period Pra of the first frame data. Accordingly, the time delay when signal processing is performed on input signals of a plurality of standards may be reduced. In particular, the payload data of the first frame data may be processed within the first frame data period Pra or the reception period Pra of the first frame data.

The signal processing device 520 according to an embodiment of the present disclosure may further include an equalizer 523*b* for reconfiguring a preamble of a first frame and a first subframe based on basic signaling data (L1B info) of the first frame data decoded by the signaling decoder 913.

The equalizer 523*b* may receive a signal from the synchronizer 521*b*, may perform signal processing on the received signal, and may output an output signal to the error corrector 524*b*.

The synchronizer 521*b* may include the bootstrap decoder 911 for decoding bootstrap data of the first frame data in the received baseband signal.

The synchronizer 521*b* may further include the timing recoverer 712 for performing timing recovery based on the signal from the bootstrap decoder 911, the cyclic extension remover 714 for removing a cyclic prefix from the signal received from the timing recoverer 712, the FFT processor 716 for performing a fast Fourier transform (FFT) on the signal from the cyclic extension remover 714, and the guard band remover 718 for removing a guard band from the signal received from the FFT processor 716.

The synchronizer 521*b* may receive the basic signaling data (L1B info) of the first frame data and the detailed signaling data (L1D info) of the first frame data from the signaling decoder 913 in the error corrector 524*b*.

The synchronizer 521*b* may perform a Fourier transform through the FFT processor 716, removal of a guard band through the guard band remover 718, or the like based on the basic signaling data (L1B info) of the first frame data and the detailed signaling data (L1D info) of the first frame data.

The equalizer 523*b* may include a frame structure regenerator 912 for regenerating a preamble of a first frame and a first subframe based on the basic signaling data (L1B info) of the first frame data.

The equalizer 523*b* may further include the interpolator 722, for extracting a pilot signal from the signal received from the synchronizer 521*b* and performing interpolation based on the extracted pilot signal, and the channel estimator 724, for extracting the pilot signal, calculating a channel transfer function value of the extracted pilot signal, and performing channel estimation based on the calculated channel transfer function value.

The interpolator 722 may perform time interpolation and frequency interpolation based on the calculated channel transfer function value.

The channel estimator 724 in the equalizer 523*b* may perform channel estimation or interpolation and may then perform channel equalization using channel information. For example, the equalizer 523*b* may perform channel equalization in the time or frequency domain.

Then, the error corrector 524*b* may include a frequency deinterleaver 732*a* for performing frequency deinterleaving based on a signal of the equalizer 523*b*, and the signaling decoder 913, for decoding the basic signaling data (L1B info) of the first frame data and the detailed signaling data (L1D info) of the first frame data based on the frequency deinterleaved signal.

The basic signaling data (L1B info) of the first frame data decoded by the signaling decoder 913 and the detailed signaling data (L1D info) of the first frame data may be output to the synchronizer 521*b*, and a time deinterleaver 732*b*.

The basic signaling data (L1B info) of the first frame data decoded by the signaling decoder 913 may be input to the frame structure reconfigurer 912 in the equalizer 523*b*. The error corrector 524*b* may further include the time deinterleaver 732*b* for performing time deinterleaving based on the frequency deinterleaved signal, the basic signaling data (L1B info) of the first frame data, and the detailed signaling data (L1D info) of the first frame data, the demapper 734 for performing demapping, and the channel decoder 736 for performing channel decoding. Accordingly, the error corrector 524*b* may perform forward error correction and may finally output bit sequence data.

The signal processing device 520 according to an embodiment of the present disclosure may begin processing the payload data of the first frame data within the first frame data period Pra or the reception period Pra of the first frame data when power is turned on or when a channel of an RF signal is changed. Accordingly, the time delay when signal processing is performed on input signals of a plurality of standards may be reduced.

When the signaling decoder 913 decodes the basic signaling data (L1B info) of the first frame data, the synchronizer 521*b* and the equalizer 523*b* may be operated to output respective signals. Accordingly, the time delay when signal processing is performed on input signals of a plurality of standards may be reduced.

Figure 15A:
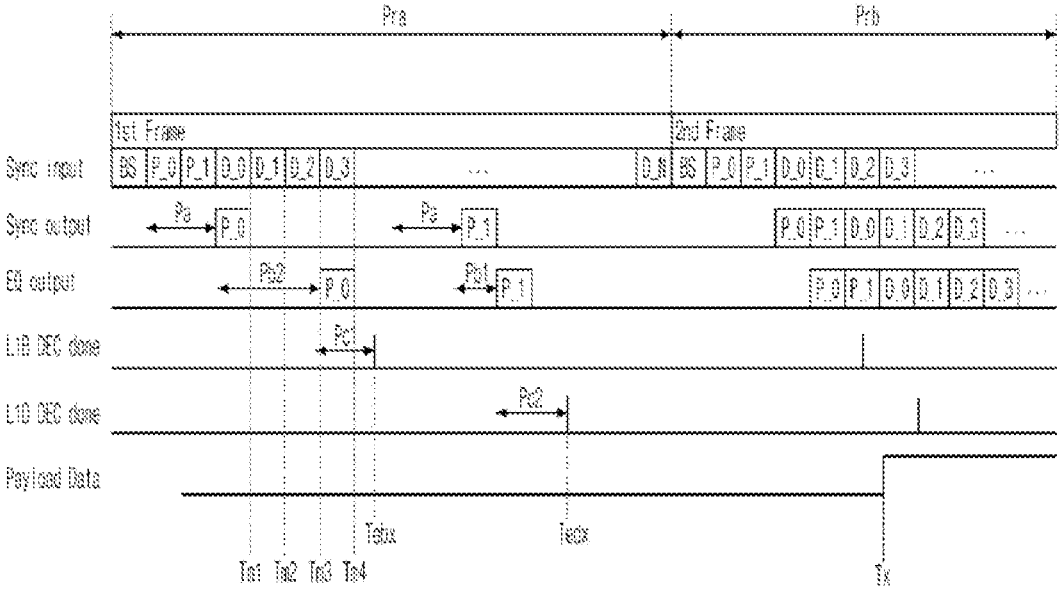
FIGS. 15A to 17 are diagrams for explaining an operation of FIG. 14.

FIG. 15A is a timing diagram showing a conventional method of processing an ATSC 3.0 signal for comparison with the present disclosure. For example, FIG. 15A is a timing diagram showing a method of processing an ATSC 3.0 signal of FIG. 13.

Referring to FIG. 15A, during the first frame data period Pra or the reception period Pra of the first frame data, bootstrap data BS, first preamble data P_0, second preamble data P_1, first subframe data D_0, second subframe data D_1, third subframe data D_2, fourth subframe data D_3, and the like may be sequentially input to a synchronizer 5201.

The time at which the first subframe data D_0, the second subframe data D_1, the third subframe data D_2, and the fourth subframe data D_3 are completely input may be Tm1, Tm2, Tm3, and Tm4, respectively.

The synchronizer 521 may perform signal processing during a period Pa, and may output the first preamble data P_0.

In this case, the time at which the synchronizer 521 completely outputs the first preamble data P_0 may be Tm1.

Then, the equalizer 523 may perform signal processing during a period Pb2 that is longer than a period Pa and may output the first preamble data P_0.

In this case, the time at which the equalizer 523 completely outputs the first preamble data P_0 may be Tm4.

Then, the error corrector 524 may perform signal processing during a period Pc1 and may completely decode the basic signaling data (L1B info) of the first frame data at a time Tebx.

After completely decoding the basic signaling data (L1B info) of the first frame data, the synchronizer 521 may perform signal processing during the period Pa and may output the second preamble data P_1.

Then, the equalizer 523 may perform signal processing and may output the second preamble data P_1.

Then, the error corrector 524 may perform signal processing during the period Pc2 and may completely decode the detailed signaling data (L1D info) of the first frame data at a time Tedx.

As such, after the basic signaling data (L1B info) of the first frame data is completely decoded, overall signal processing may be delayed by performing signal processing of the second preamble data P_1.

In particular, the time Tx at which a signal of the payload data is processed may be within a second frame data period Prb or a reception period Prb of second frame data, but not within the first frame data period Pra or the reception period Pra of the first frame data. Thus, when a frame duration is about 50 ms to about 5 s, the first frame period may be delayed.

Figure 15B:
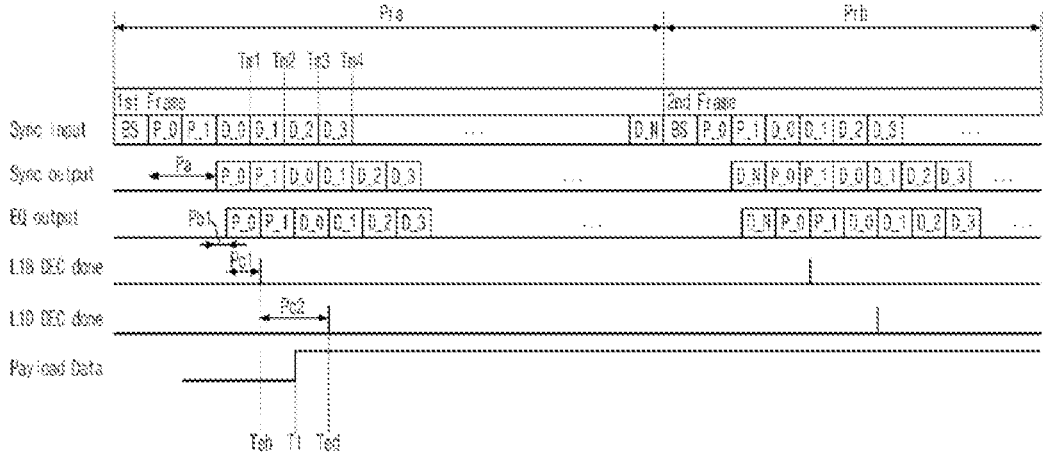

FIG. 15B is a timing diagram showing a method of processing an ATSC 3.0 signal according to an embodiment of the present disclosure. For example, FIG. 15B is a timing diagram showing a method of processing an ATSC 3.0 signal of FIG. 14.

Referring to FIG. 15B, during the first frame data period Pra or the reception period Pra of the first frame data, the bootstrap data BS, the first preamble data P_0, the second preamble data P_1, the first subframe data D_0, the second subframe data D_1, the third subframe data D_2, the fourth subframe data D_3, and the like may be sequentially input to the synchronizer 5201.

The times at which the first subframe data D_0, the second subframe data D_1, the third subframe data D_2, and the fourth subframe data D_3 are completely input may be Tm1, Tm2, Tm3, and Tm4, respectively.

The synchronizer 521*b* may perform signal processing during the period Pa and may sequentially output the first preamble data P_0, the second preamble data P_1, the first subframe data D_0, the second subframe data D_1, the third subframe data D_2, the fourth subframe data D_3, and the like.

In this case, the time at which the synchronizer 521*b* completely outputs the first preamble data P_0, the second preamble data P_1, the first subframe data D_0, and the second subframe data D_1 may be Tm1, Tm2, Tm3, and Tm4, respectively.

Then, the equalizer 523*b* may perform signal processing during a period Pb1, which is shorter than a period Pa and may output the first preamble data P_0.

In particular, the equalizer 523*b* may begin processing a signal in advance, prior to outputting of the first preamble data P_0 by the synchronizer 521*b*, and may output the first preamble data P_0 between Tm1 and Tm2.

After the time Tm1, the equalizer 523*b* may sequentially output the first preamble data P_0, the second preamble data P_1, the first subframe data D_0, the second subframe data D_1, the third subframe data D_2, the fourth subframe data D_3, and the like.

Then, prior to the time Tm1, the signaling decoder 913 in the error corrector 524*b* may begin decoding the basic signaling data (L1B info) of the first frame data and may output the basic signaling data (L1B info) of the decoded first frame data between Tm1 and Tm2.

The signaling decoder 913 in the error corrector 524*b* may perform signal processing during a period Pc1, which is shorter than a period Pa, and may output the basic signaling data (L1B info) of the decoded first frame data.

The time at which the basic signaling data (L1B info) of the first frame data is completely decoded or output may be Teb.

After Tm1, the equalizer 523*b* may sequentially output the first preamble data P_0, the second preamble data P_1, the first subframe data D_0, the second subframe data D_1, the third subframe data D_2, the fourth subframe data D_3, and the like, and thus the signaling decoder 913 in the error corrector 524*b* may completely decode the basic signaling data (L1B info) of the first frame data and may then immediately decode the detailed signaling data (L1D info) of the first frame data.

The signaling decoder 913 in the error corrector 524*b* may perform signal processing during a period Pc2, which is longer than a period Pc1, and may output the detailed signaling data (L1D info) of the decoded first frame data.

In this case, the time at which the detailed signaling data (L1D info) of the first frame data is completely decoded or output may be Ted.

After Tm1, the equalizer 523*b* may sequentially output the first preamble data P_0, the second preamble data P_1, the first subframe data D_0, the second subframe data D_1, the third subframe data D_2, the fourth subframe data D_3, and the like, and thus, the time T1, at which a signal of payload data is processed, may be within the first frame data period Pra or the reception period Pra of the first frame data.

The drawing shows an example in which the time T1 at which the signal of the payload data is processed is after the time Teb at which the basic signaling data (L1B info) of the first frame data is decoded and may be within the time Ted at which the detailed signaling data (L1D info) of the first frame data is completely decoded.

Accordingly, the time delay when signal processing is performed on input signals of a plurality of standards may be reduced. In particular, payload data of the first frame data may be processed within the first frame data period Pra or the reception period Pra of the first frame data.

Thus, it may be possible to process and output a signal immediately from the first frame data.

The time Teb at which the basic signaling data (L1B info) of the first frame data is completely decoded may be after the time Tm1 at which the first subframe data D_0 of the first frame data input to the synchronizer 521*b* is completely input and may be before the time Tm2 at which the second subframe data D_1 of the first frame data is completely input. Accordingly, the time delay when signal processing is performed on input signals of a plurality of standards may be reduced.

The time Teb at which the basic signaling data (L1B info) of the first frame data is completely decoded may be after the time Tm1 at which the first preamble data P_0 of the first frame data output from the synchronizer 521*b* is completely output, and may be before the time Tm2 at which the second preamble data P_1 of the first frame data output from the synchronizer 521*b* is completely output or may be before the time at which the first subframe data D_0 of the first frame data output from the synchronizer 521*b* is completely output. Accordingly, the time delay when signal processing is performed on input signals of a plurality of standards may be reduced.

The basic signaling data (L1B info) of the decoded first frame data may include information on the number of preambles of the first frame, and information on a reduced carrier mode of the first subframe. Accordingly, the time delay when signal processing is performed on input signals of a plurality of standards may be reduced.

After completely decoding the basic signaling data (L1B info) of the first frame data, the signaling decoder 913 may decode the detailed signaling data (L1D info) of the first frame data. Accordingly, the time delay when signal processing is performed on input signals of a plurality of standards may be reduced.

The time Ted at which the detailed signaling data (L1D info) of the first frame data is completely decoded may be after the time Tm3 at which the third subframe data D_2 of the first frame data input to the synchronizer 521*b* is completely input and may be before the time Tm4 at which the fourth subframe data D_3 of the first frame data is completely input. Accordingly, the time delay when signal processing is performed on input signals of a plurality of standards may be reduced.

The time Ted at which the detailed signaling data (L1D info) of the first frame data is completely decoded may be after the time at which the second subframe data D_1 of the first frame data output from the synchronizer 521*b* is completely output. Accordingly, the time delay when signal processing is performed on input signals of a plurality of standards may be reduced.

FIG. 15C is a diagram showing an example of syntax of the basic signaling data (L1B info).

Referring to FIG. 15C, L1B_papr_reduction, L1B_framer_length_mode, L1B_preamble_reduced_carriers, L1B_first_sub_fft_size, L1B_first_sub_reduced_carriers,
L1B_first_sub_guard_interval,
L1B_first_sub_scattered_pilot_pattern,
L1B_first_sub_scattered_pilot_boost, and the like may indicate information on parameters required for operations in units of symbols.

L1B_num_subframes, L1B_preamble_num_symbols, L1B_first_sub_num_ofdm_symbols, L1B_first_sub_sbs_first, L1B_first_sub_guard_last, and the like may contain information on parameters required to regenerate a frame structure.

Thus, the frame structure reconfigurer 912 may regenerate the frame structure using L1B_num_subframes, L1B_preamble_num_symbols, L1B_first_sub_num_ofdm_symbols, L1 B_first_sub_sbs_first, L1B_first_sub_guard_last, and the like in the basic signaling data (L1B info).

Data of L1B_preamble_reduced_carriers and L1B_first_sub_reduced_carriers may be used for the time at which the equalizer 523*b* is operated.

The synchronizer 521*b* may output maximum carrier number information Max Noc.

Figures 15D, 16A:
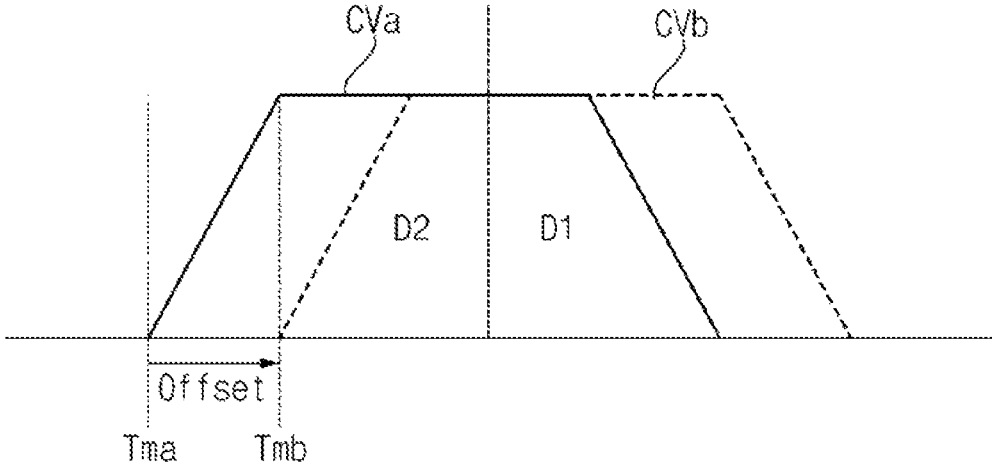

FIG. 15D shows the number of carriers (NoC) for respective FFT modes (8K FFT, 16K FFT, and 32K FFT) when a parameter of a reduced carrier mode has a value of 0 to 4.

The equalizer 523*b* may completely decode the basic signaling data (L1B info) of the first frame data and may then operate from a time delayed by an offset period Offset based on the time at which the maximum carrier number information Max Noc received from the synchronizer 521*b* begins.

Figure 16B:
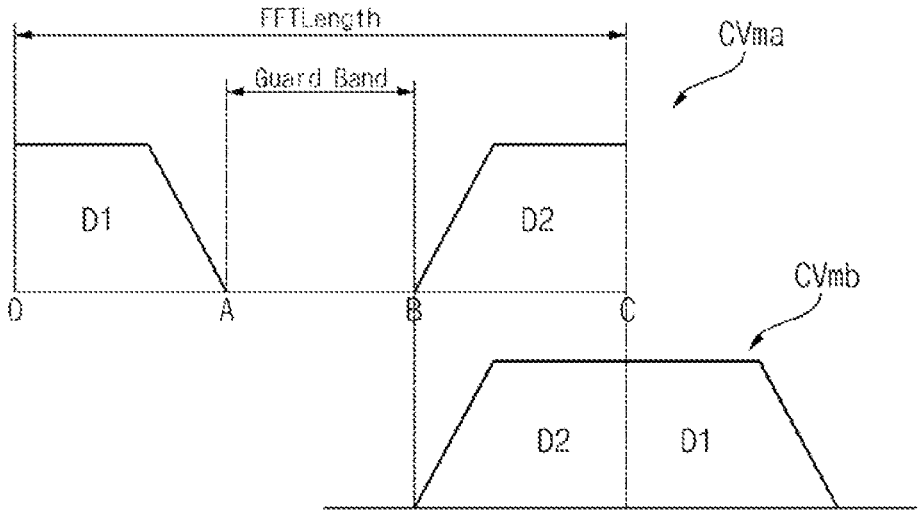

FIG. 16B shows an example of a plot CVma according to a Fourier transform in the synchronizer 521*b* and a plot CVMb according to removal of a guard band in the synchronizer 521*b*.

As a result, the synchronizer 521*b* may output the plot CVMb according to removal of the guard band.

FIG. 16A is a diagram showing an example of variation of the time at which the equalizer 523*b* is operated.

Referring to FIG. 16A, the equalizer 523*b* may be operated at the time Tmb by an offset period Offset based on the time Tma at which the maximum carrier number information Max Noc received from the synchronizer 521*b* begins.

When the basic signaling data (L1B info) of the first frame data is completely decoded and then the basic signaling data (L1B info) of the first frame data is received, a time needs to be partially delayed for a normal operation based on a parameter within the received basic signaling data, as shown in FIG. 15C.

Accordingly, as shown in FIG. 16A, the equalizer 523*b* may be operated based on the plot CVb rather than the plot CVa.

As the beginning time varies, only an effective sub-carrier may be used.

Figure 17:
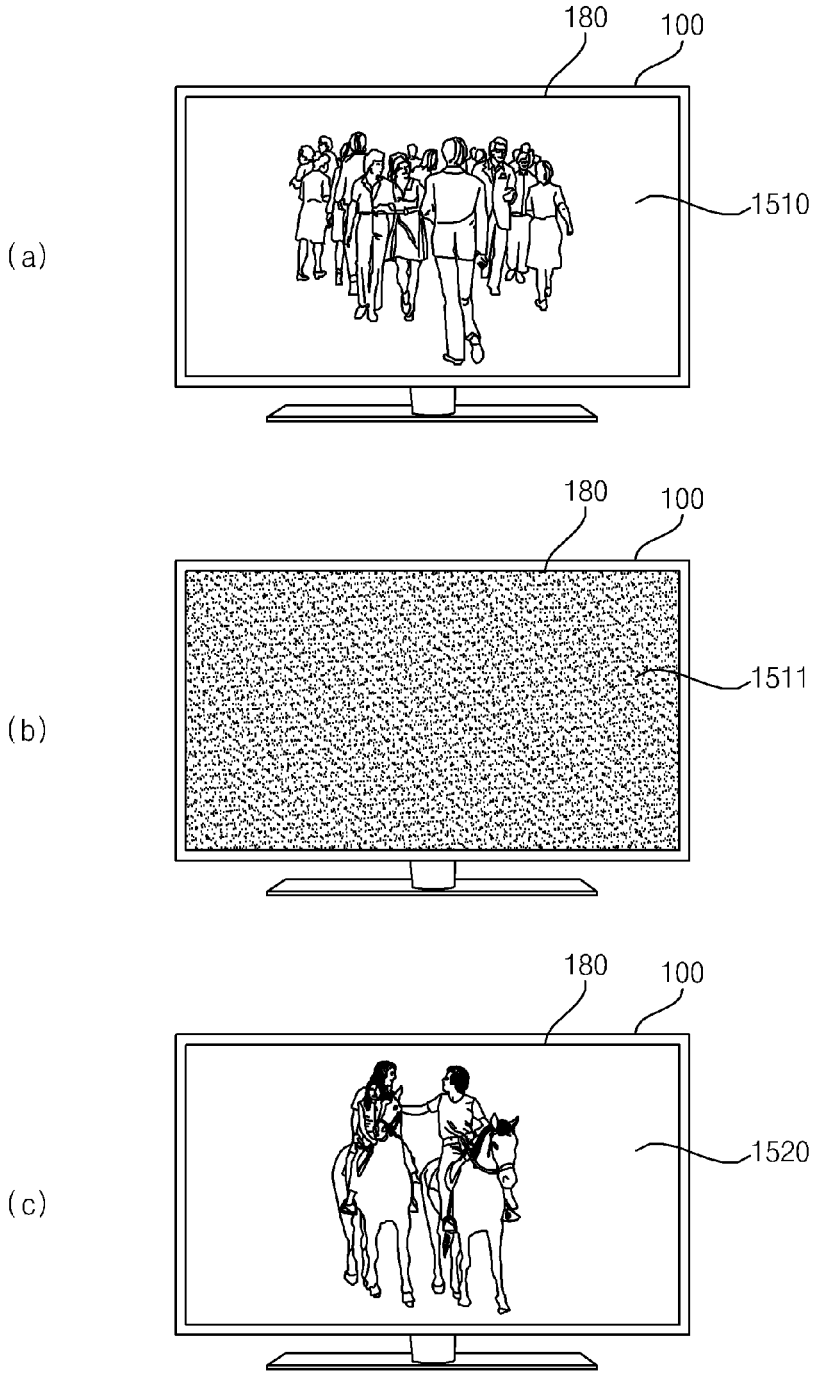

FIG. 17 is a diagram showing an example of a broadcast image depending on ON or OFF of time interpolation in a static channel and a mobile channel.

(a) of FIG. 17 shows an example in which a broadcast image 1510 is displayed on a display 180 of an image display apparatus 100 when payload data of first frame data begins to be processed within the first frame data period Pra or the reception period Pra of the first frame data, as shown in FIG. 14 or 15B.

Accordingly, the broadcast image 1510 from which the defect has been removed may be displayed from the first frame period.

(b) of FIG. 17 shows an example in which an image 1511 having a defect is displayed when the payload data of the first frame data does not begin to be processed within the first frame data period Pra or the reception period Pra of the first frame data, as shown in FIG. 13 or 15A.

(c) of FIG. 17 shows an example in which a broadcast image 1520 from which the defect has been removed is displayed when the payload data of the first frame data begins to be processed during the second frame data period Prb or the reception period Prb of the second frame data, as shown in FIG. 13 or 15A.

According to an embodiment of the present disclosure, a wireless reception device and an image display apparatus including the same may include a first signal converter configured to convert an input signal based on the RF signal into a first baseband signal, a second signal converter configured to convert the input signal based on the RF signal into a second baseband signal, a processor of a first standard configured to perform signal processing on the first baseband signal from the first signal converter based on the first standard, and a first processor of a second standard configured to perform signal processing on the second baseband signal from the second signal converter based on the second standard, wherein, when standard of the input signal based on the RF signal is not detected, the processor of the first standard performs signal processing on the first baseband signal from the first signal converter based on the first standard during a first period, and the first processor of the second standard performs signal processing on the second baseband signal from the second signal converter based on the second standard during the first period, when the standard of the input signal is detected by the signal processing during the first period, the first signal converter outputs a baseband signal of the first standard or a baseband signal of the second standard based on the detected standard during a second period after the first period. Accordingly, the time delay when signal processing is performed on input signals of a plurality of standards may be reduced. In particular, it is possible to reduce the time delay during signal processing when the standard of the input signal is not detected.

When the input signal based on the RF signal is detected as a first input signal of the first standard, the first signal converter converts the first input signal of the first standard into the first baseband signal, the processor of a first standard processes the first baseband signal from the first signal converter based on the first standard, and the first processor of a second standard does not operate, when the input signal based on the RF signal is detected as a second input signal of the second standard, the second signal converter converts the second input signal of the second standard into the second baseband signal using sample rate information processed by the first processor of the second standard during the first period. Accordingly, the time delay when signal processing is performed on input signals of a plurality of standards may be reduced. In particular, it is possible to reduce the time delay during signal processing when the standard of the input signal is not detected.

A sample rate of the first baseband signal output from the first signal converter and a sample rate of the second baseband signal output from the second signal converter may be different from each other. Accordingly, the time delay when signal processing is performed on input signals of a plurality of standards may be reduced.

The wireless reception device and the image display apparatus including the same may further include a second processor of the second standard configured to perform second signal processing of the second standard based on a signal output from the first processor of the second standard. Accordingly, the time delay when signal processing is performed on input signals of a plurality of standards may be reduced.

The first processor of the second standard may decode bootstrap data, and the second processor of the second standard may decode preamble data and subframe data. Accordingly, the time delay when signal processing is performed on input signals of a plurality of standards may be reduced.

When the input signal based on the RF signal is the first input signal of the first standard, the first signal converter may convert the first input signal of the first standard into the first baseband signal, and the second signal converter and the first processor of the second standard may not be operated. Accordingly, the time delay when signal processing is performed on the first input signal of the first standard may be reduced.

When the input signal based on the RF signal is the second input signal of the second standard, the second signal converter may convert the second input signal of the second standard into the second baseband signal, the first processor of the second standard may perform signal processing based on the second baseband signal and outputs sample rate information, obtained via the signal processing, to the first signal converter, and the first signal converter may convert the second input signal of the second standard into a third baseband signal based on the sample rate information from the first processor of the second standard. Accordingly, the time delay when signal processing is performed on the second input signal of the second standard may be reduced.

The wireless reception device and the image display apparatus including the same may further include a second processor of the second standard configured to perform signal processing based on the third baseband signal from the first signal converter. Accordingly, the time delay when signal processing is performed on the second input signal of the second standard may be reduced.

When the first signal converter receives the sample rate information, a sample rate of the third baseband signal may be different from a sample rate of the first baseband signal and a sample rate of the second baseband signal. Accordingly, the time delay when signal processing is performed on the second input signal of the second standard may be reduced. When the first signal converter receives the sample rate information, the third baseband signal may have a plurality of sample rates. Accordingly, the time delay when signal processing is performed on the second input signal of the second standard may be reduced.

Payload data of the first frame data may begin to be processed within a first frame data period or a reception period of first frame data. Accordingly, a time taken to output data based on processing of frame data may be reduced.

The wireless reception device and the image display apparatus including the same may further include an equalizer configured to regenerate a preamble of the first frame data and the first subframe based on basic signaling data of the first frame data decoded by the first processor of the second standard. Accordingly, a time taken to output data based on processing of frame data may be reduced.

A time at which basic signaling data of the first frame data is completely decoded may be after a time at which first subframe data of the first frame data input to the synchronizer is completely input and may be before a time at which second subframe data of the first frame data is completely input. Accordingly, a time taken to output data based on processing of frame data may be reduced.

According to another embodiment present disclosure, a wireless reception device and an image display apparatus including the same may include a first signal converter configured to convert an input signal based on the RF signal into a first baseband signal, a second signal converter configured to convert the input signal based on the RF signal into a second baseband signal, a processor of a first standard configured to perform signal processing on the first baseband signal from the first signal converter based on the first standard, and a first processor of a second standard configured to perform signal processing on the second baseband signal from the second signal converter based on the second standard, wherein, when standard of the input signal based on the RF signal is not detected, the processor of the first standard and the first processor of the second standard do not sequentially operate with each other, and the processor of the first standard and the first processor of the second standard simultaneously perform respective signal processing operations. Accordingly, the time delay when signal processing is performed on input signals of a plurality of standards may be reduced. In particular, it is possible to reduce the time delay during signal processing when the standard of the input signal is not detected.

According to embodiment present disclosure, an image display apparatus including the same may comprises a wireless reception device for receiving a radio frequency (RF) signal received through a channel, a signal processing device configured to process an signal from the wireless reception device, and a display configured to display an image based on a video signal from the signal processing device. Accordingly, the broadcast image from which the defect has been removed may be displayed.

Operations performed by a wireless reception device or an image display apparatus according to the present disclosure may be embodied as processor-readable code on a processor-readable recording medium. The processor-readable recording medium may include any data storage device that is capable of storing programs or data which is capable of being thereafter read by a processor. The processor-readable recording medium may also be distributed over network coupled computer systems so that the computer readable code is stored and executed in a distributed fashion.

While the present disclosure has been particularly shown and described with reference to exemplary embodiments thereof, it is to be understood that the same is by way of illustration and example only and is not to be taken in conjunction with the present disclosure. It will be understood by those skilled in the art that various changes in form and details may be made therein without departing from the subject matter and scope of the present disclosure.

What is claimed is:

1. A wireless reception device for receiving a radio frequency (RF) signal received through a channel, the wireless reception device comprising:

a first signal converter configured to convert an input signal based on the RF signal into a first baseband signal;

a second signal converter configured to convert the input signal based on the RF signal into a second baseband signal;

a processor of a first standard configured to perform signal processing on the first baseband signal from the first signal converter based on the first standard; and a first processor of a second standard configured to perform signal processing on the second baseband signal from the second signal converter based on the second standard, wherein, when standard of the input signal based on the RF signal is not detected, the processor of the first standard performs signal processing on the first baseband signal from the first signal converter based on the first standard during a first period, and the first processor of the second standard performs signal processing on the second baseband signal from the second signal converter based on the second standard during the first period, wherein when the standard of the input signal is detected by the signal processing during the first period, the first signal converter outputs a baseband signal of the first standard or a baseband signal of the second standard based on the detected standard during a second period after the first period.

2. The wireless reception device of claim 1, wherein when the input signal based on the RF signal is detected as a first input signal of the first standard, the first signal converter converts the first input signal of the first standard into the first baseband signal, the processor of a first standard processes the first baseband signal from the first signal converter based on the first standard, and the first processor of a second standard does not operate, wherein when the input signal based on the RF signal is detected as a second input signal of the second standard, the second signal converter converts the second input signal of the second standard into the second baseband signal using sample rate information processed by the first processor of the second standard during the first period.

3. The wireless reception device of claim 1, wherein a sample rate of the first baseband signal output from the first signal converter and a sample rate of the second baseband signal output from the second signal converter are different from each other.

4. The wireless reception device of claim 1, further comprising a second processor of the second standard configured to perform second signal processing of the second standard based on a signal output from the first processor of the second standard.

5. The wireless reception device of claim 4, wherein the first processor of the second standard decodes bootstrap data, and the second processor of the second standard decodes preamble data and subframe data.

6. The wireless reception device of claim 1, wherein the first standard is an ATSC 1.0 standard, and the second standard is an ATSC 3.0 standard.

7. The wireless reception device of claim 1, wherein, when the input signal based on the RF signal is the first input signal of the first standard, the first signal converter converts the first input signal of the first standard into the first baseband signal, and the second signal converter and the first processor of the second standard are not operated.

8. The wireless reception device of claim 1, wherein, when the input signal based on the RF signal is the second input signal of the second standard, the second signal converter converts the second input signal of the second standard into the second baseband signal, the first processor of the second standard performs signal processing based on the second baseband signal and outputs sample rate information, obtained via the signal processing, to the first signal converter, and the first signal converter converts the second input signal of the second standard into a third baseband signal based on the sample rate information from the first processor of the second standard.

9. The wireless reception device of claim 8, further comprising a second processor of the second standard configured to perform signal processing based on the third baseband signal from the first signal converter.

10. The wireless reception device of claim 8, wherein, when the first signal converter receives the sample rate information, a sample rate of the third baseband signal is different from a sample rate of the first baseband signal and a sample rate of the second baseband signal.

11. The wireless reception device of claim 8, wherein, when the first signal converter receives the sample rate information, the third baseband signal has a plurality of sample rates.

12. The wireless reception device of claim 4, wherein the preamble data includes basic signaling data and detailed signaling data.

13. The wireless reception device of claim 4, further comprising:

a synchronizer including a first processor of the second standard; and an error corrector including a second processor of the second standard.

14. The wireless reception device of claim 13, wherein payload data of the first frame data begins to be processed within a first frame data period or a reception period of first frame data.

15. The wireless reception device of claim 13, further comprising an equalizer configured to regenerate a preamble of the first frame data and the first subframe based on basic signaling data of the first frame data decoded by the first processor of the second standard.

16. The wireless reception device of claim 14, wherein a time at which basic signaling data of the first frame data is completely decoded is after a time at which first subframe data of the first frame data input to the synchronizer is completely input and is before a time at which second subframe data of the first frame data is completely input.

17. The wireless reception device of claim 1, further comprising a tuner module configured to receive the RF signal.

18. A wireless reception device for receiving a radio frequency (RF) signal received through a channel, the wireless reception device comprising:

a first signal converter configured to convert an input signal based on the RF signal into a first baseband signal;

a second signal converter configured to convert the input signal based on the RF signal into a second baseband signal;

a processor of a first standard configured to perform signal processing on the first baseband signal from the first signal converter based on the first standard; and a first processor of a second standard configured to perform signal processing on the second baseband signal from the second signal converter based on the second standard, wherein, when standard of the input signal based on the RF signal is not detected, the processor of the first standard and the first processor of the second standard do not sequentially operate with each other, and the processor of the first standard and the first processor of the second standard simultaneously perform respective signal processing operations.

19. An image display apparatus comprising:

a wireless reception device for receiving a radio frequency (RF) signal received through a channel;

a signal processing device configured to process an signal from the wireless reception device; and a display configured to display an image based on a video signal from the signal processing device, wherein the wireless reception device comprising:

a first signal converter configured to convert an input signal based on the RF signal into a first baseband signal;

a second signal converter configured to convert the input signal based on the RF signal into a second baseband signal;

a processor of a first standard configured to perform signal processing on the first baseband signal from the first signal converter based on the first standard; and a first processor of a second standard configured to perform signal processing on the second baseband signal from the second signal converter based on the second standard, wherein, when standard of the input signal based on the RF signal is not detected, the processor of the first standard performs signal processing on the first baseband signal from the first signal converter based on the first standard during a first period, and the first processor of the second standard performs signal processing on the second baseband signal from the second signal converter based on the second standard during the first period, wherein when the standard of the input signal is detected by the signal processing during the first period, the first signal converter outputs a baseband signal of the first standard or a baseband signal of the second standard based on the detected standard during a second period after the first period.

20. The image display apparatus of claim 19, wherein when the input signal based on the RF signal is detected as a first input signal of the first standard, the first signal converter converts the first input signal of the first standard into the first baseband signal, the processor of a first standard processes the first baseband signal from the first signal converter based on the first standard, and the first processor of a second standard does not operate, wherein when the input signal based on the RF signal is detected as a second input signal of the second standard, the second signal converter converts the second input signal of the second standard into the second baseband signal using sample rate information processed by the first processor of the second standard during the first period.

* * * * *